US006463010B1

(12) United States Patent
Nakamiya et al.

(10) Patent No.: US 6,463,010 B1
(45) Date of Patent: Oct. 8, 2002

(54) ELECTRONIC TIMEPIECE AND METHOD FOR CONTROLLING THE SAME

(75) Inventors: Shinji Nakamiya, Matsumoto; Teruhiko Fujisawa, Shiojiri; Sho Matsuzaki, Chino, all of (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 09/718,822

(22) Filed: Nov. 22, 2000

(30) Foreign Application Priority Data

Nov. 24, 1999 (JP) ..... 11-333526

(51) Int. Cl.[7] ..... G04B 1/00; G04B 9/00
(52) U.S. Cl. ..... 368/64; 368/66; 368/204
(58) Field of Search ..... 368/64, 66, 204; 320/127, 128, 134, 137, 161, 162

(56) References Cited

U.S. PATENT DOCUMENTS

| | | | | |
|---|---|---|---|---|
| 5,933,392 A | * | 8/1999 | Sato et al. | 368/157 |
| 5,978,318 A | * | 11/1999 | Kawaguchi et al. | 368/66 |
| 6,021,097 A | * | 2/2000 | Kanno et al. | 368/64 |
| 6,061,304 A | * | 5/2000 | Nagata et al. | 368/66 |

FOREIGN PATENT DOCUMENTS

| | | |
|---|---|---|
| JP | 62-242882 | 10/1987 |
| JP | 5-264751 | 10/1993 |
| JP | 2534484 | 9/1996 |
| JP | 11-64546 | 3/1999 |
| JP | 11-64548 | 3/1999 |
| WO | WO98/06013 | 2/1998 |
| WO | WO00/23852 | 4/2000 |

* cited by examiner

*Primary Examiner*—Vit Miska
(74) *Attorney, Agent, or Firm*—Michael T. Gabrik

(57) ABSTRACT

An electronic timepiece comprises a battery, capable of charging, a charging section for charging the battery, a timepiece control circuit performing time keeping operation by using a stored electric power in the battery, a display for displaying time kept by the timepiece control circuit, a voltage detecting circuit for detecting a voltage of the stored voltage of the battery, and a charging detecting section for detecting a state of charging to the battery, and this timepiece, when the voltage of the stored voltage declines below a first prescribed voltage which is higher than an operation stop voltage of the timepiece control circuit, and non-charging state is detected for a prescribed time period, executes a forcible stop upon the time keeping operation by lowering or shutting off a current for the timepiece control circuit, and lifts the forcible stop when a prescribed operation return condition is satisfied.

25 Claims, 21 Drawing Sheets

ELECTRONIC TIMEPIECE AND METHOD FOR CONTROLLING THE SAME

BACKGROUND OF THE INVENTION

1. Field of the Invention

The present invention relates to method and circuit for drive control of electronic timepiece with generator, charger or chargeable battery.

2. Background Art

There are electronic timepieces having generators and timepiece circuits driven by the power supplied from the generators. There are other types of electronic time pieces having timepiece circuits, chargeable power sources such as chargeable battery or capacitor in them or as a removable unit for storage of electricity, and in the chargeable power source store electrical power supplied from internal or external generators, and operate by the power. As generators for electronic timepieces, there are some ways such as a rotating-type generator driven by kinetic energy which is seized by an oscillating weight and the like, and such as solar cell and the like which seizes light energy. For chargeable batteries for electronic timepieces, some of them receive electrical energy generated by external generators with electrically direct connection or induction by electromagnetic wave.

There are some requests to the stated electronic timepiece having generating function or electricity storing function. One is to make it possible to keep stability of initial time displaying operation after left untouched for a long time. Another one is to regain regular circuit operation when the stored electrical power decreases and the circuit operation stops and then the stored electricity returns. Another one is to inform a user of precise remaining stored electricity. Prior arts trying to meet these demands are disclosed in International Publication WO98/06013 entitled "Electrical timepiece", Japanese Patent Application Laid-Open Publication No. 11-64546 entitled "An electronic apparatus with generating apparatus and resetting method of an electronic apparatus with generating apparatus", and Japanese Patent Application Laid-Open Publication No. 11-64548 entitled "An electronic apparatus with generating apparatus, a controlling method over a power source state of an electronic apparatus with generating apparatus, and a storage media storing a program which controls a power source state of an electronic apparatus with generating apparatus". Next, the outlines and technical limits of these prior arts written in the above publication will be described.

International Publication WO98/060presents two following techniques. The first is a technique by which, when the stored electricity decreases below a prescribed reference voltage, a time display is stopped, and when a condition for returning operation is satisfied, time keeping operation is resumed and continued at least, for a prescribed period. The second is a technique by which when the stored electricity decreases below a prescribed reference voltage, a time display is stopped, and when a generation detect means detects generation of electrical energy more than a prefixed level, time keeping operation is resumed and continued at least for a prescribed period. In the first technique, when a detection of time-setting is performed by user, the condition for returning operation is satisfied. Therefore time keeping operation can be resumed even when charging to the storing means is not occurring. Under this condition, without charging to the storing means, time keeping operation can be resumed and stopped again and again, the stored electricity is consumed. Therefore the stored electricity is easily to stray off the prescribed condition to continue to keep time, and it becomes impossible to guarantee a notified time for time-keeping.

At the same time, in the first technique, when detection of a meeting the condition for operation return is made, time keeping operation is resumed, and the above reference voltage is lowered by one level, thereby the resumed time keeping operation will be continued until the stored electricity decreases less than the changed reference voltage. In this case, the stored electricity required for resuming; time keeping operation after stopping declines step by step. Therefore, when this action is carried out several times, time keeping operation will be executed even until the stored electricity is low. Then there is a possibility that after the timepiece drive circuit is stopped, a leakage current in the timepiece drive circuit consumes the stored electricity to almost null in a short time. When the timepiece is again used, the stored electricity requires long charging time to reach a drive starting potential for the timepiece, resulting in worsen resuming response, which is a problem in this technique.

On the other hand, in the second technique, when the generation detect means detects more electrical energy generated than a prefixed threshold level, time keeping operation is resumed. Therefore, under some relation between stored electricity and the threshold level, there is a possibility that even a generation which does not charge can resume the timepiece. In this case, resuming and stopping of the timepiece are alternatively repeated without charging. This results in consuming the stored electricity. As a result, the prescribed condition to continue to operate the timepiece is missed more quickly, therefore there is a possibility of failing to guarantee a notified timepiece operation period.

Japanese Patent Application Laid-Open Publication No. 11-64546 presents a technique, in which, after a battery voltage falls below a drive voltage for timepiece and operation of circuits of the timepiece is stopped, if charging is resumed by the soler cell and then battery voltage returns larger than the drive voltage for timepiece, a reset signal will be emitted to return the operation of the circuits to normal operation. In this technique, however, the circuit operation will be conducted until the battery voltage becomes below the drive voltage for timepiece. There is a possibility that, after the battery voltage declines below the drive voltage for timepiece and circuits is stopped, if the timepiece is left, untouched, a leakage current in the circuits consumes the stored electricity to almost, null in a short time. Then when the timepiece is again used, the stored electricity requires long charging time to reach a drive starting potential for the timepiece, resulting in worsen resuming response, which is a problem in this technique.

Furthermore, when the battery voltage becomes larger than the drive voltage of the timepiece, a reset signal is emitted and circuits are resumed. Therefore, without generation by solar panel and the like, a self return characteristic of batteries can possibly resume the timepiece or the circuit. In this case, because the stored electricity in the battery is small, the operation does not continue long. The repetition of this operation consumes the stored electricity in the battery to almost null in a short time. Therefore, when the timepiece is again used, the stored electricity requires long charging time to reach a drive starting potential for the timepiece, resulting in worsen resuming response, which is a problem in this technique.

Japanese Patent Application Laid-Open Publication No. 11-64546 presents a technique that a user is notified of a consumption condition of the battery, this resulting in a preventive attempt for the timepiece from stopping suddenly without notification. The way to achieve the purpose is to display an indication for battery remaining amount when the battery voltage falls and the voltage detection result becomes below a first voltage, to prohibit an operation of a buzzer or an electroluminescence element for illuminating the display section when the voltage detection result falls below a second voltage, and to prohibit the time display operation when the voltage detection result falls below a third voltage. This techniques makes a notification, based on the voltage detection results, of the consumption condition of the battery by the above operation of the timepiece. However, relation between battery voltage and stored electricity differs based on charging condition, unevenness of battery quality, quality deterioration, temperature characteristic, and the like. Therefore, even the identical voltage does not mean the same possible operation time, and resulting in the possibility that precise notification of the consumption condition of the battery is not attained. Especially at the last discharging stage of the battery, that is in the time just before the timepiece stops, it is desirable to notify a user of more precise remaining time of the timepiece operation. However, under this technique, there is a possibility that, under a certain condition, the timepiece stops before the user confirms it.

By taking the above situation into considering, the object of the present, invention is to provide an electronic timepiece and its electronic circuit with a drive control method which can attain stabler time keeping operation when the stored electricity is small, quicker response when resuming, and more precise notification of remaining time of the operation.

SUMMARY OF THE INVENTION

In order to solve all the above problems, the present invention provides an electronic timepiece comprising a battery capable of charging, a charging section for charging the battery, a timepiece drive circuit operating time keeping operation by using a stored electric power in the battery, a displaying section for displaying time kept by the timepiece drive circuit, a voltage detecting section for detecting a stored voltage, of the battery, a charging detecting section for detecting a state of charging by the charging section, a control section for executing a forcible stop upon an operation of the timepiece drive circuit to reduce or stop a consumption power of the timepiece drive circuit when satisfying, for a prescribed time, a first condition that the stored voltage detected by the voltage detecting section is lower than a first prescribed voltage which is higher than an operation stop voltage of the timepiece drive circuit, and a second condition that a detection result of the charging detecting section indicates that the battery is not charged, and for lifting the forcible stop upon the time keeping operation when the detection result of the voltage detecting section or the charging detecting section satisfies a prescribed operation return condition.

Under the above construction, in a case in which the battery voltage declines and becomes lower than a first pre-scribed voltage which is higher than the timepiece drive circuit stop voltage, when the charging detect function measures non-charging state for a pre-scribed time period, a forcible stop is done upon the time keeping operation by lowering or shutting off a current for the timepiece drive circuit. By this, at the first voltage that is higher than the timepiece drive circuit stop voltage, the forcible stop is done upon the time keeping operation, and at the same time, operation current is lowered or shut down, hence it takes longer for battery voltage to decline to a degree of around zero volt, and it becomes possible for the timepiece to resume in a short charging time period when used next time. After the battery voltage falling below the first pre-scribed voltage, when non-charging state lasts for a pre-scribed time period, timepiece operation will stop. Hence it is possible to guarantee users precise remaining time of the time keeping.

DESCRIPTION OF THE PREFERRED EMBODIMENT

Figure 1:
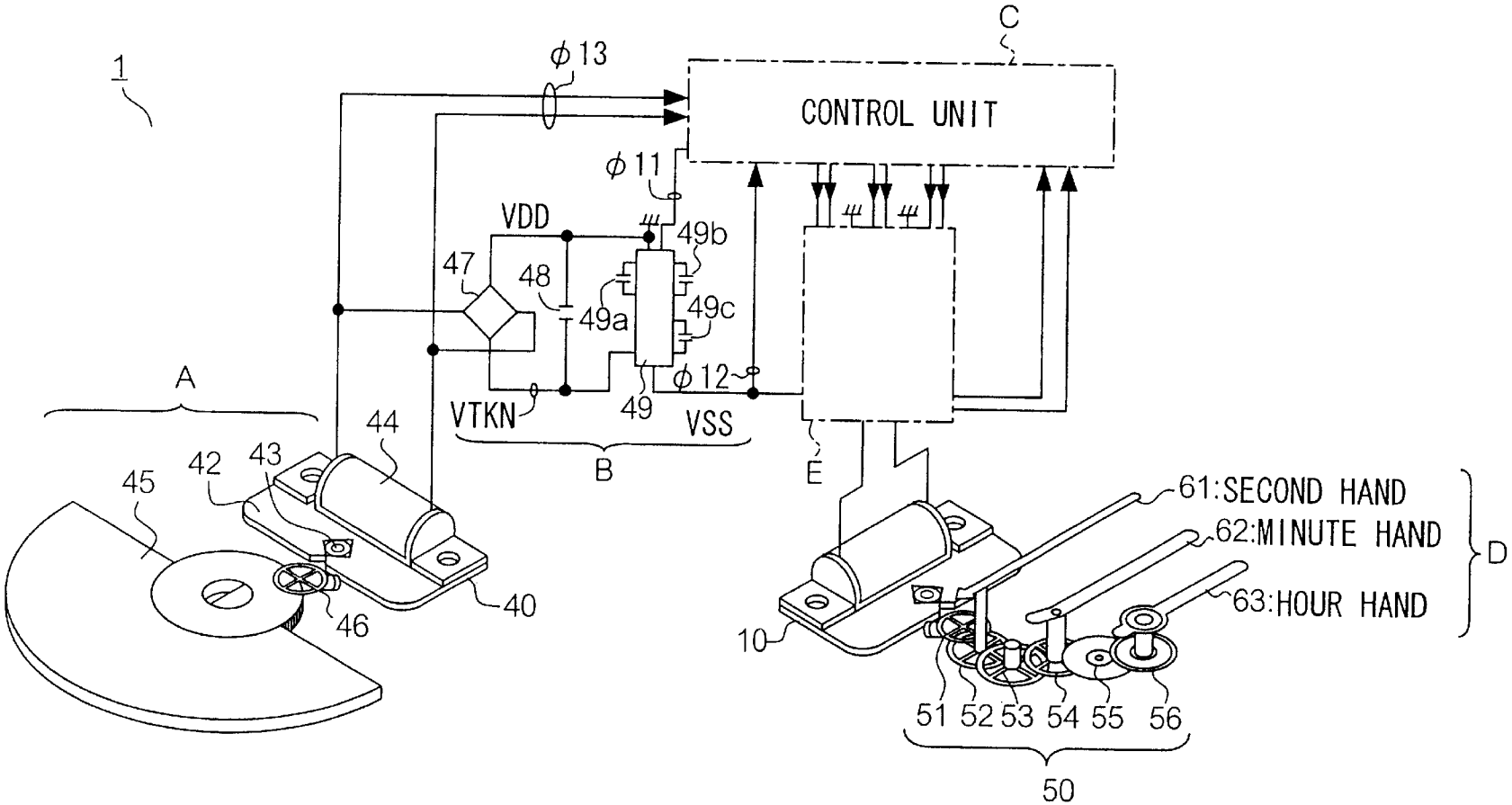
FIG. 1 is a block diagram which shows an outline of one embodiment of the present invention.

FIG. 1 is a block diagram which shows an outline of an electronic timepiece. 1 according to a preferred embodiment of the present invention. The electronic timepiece 1 shown in FIG. 1 is a wrist watch. The user of this timepiece wears it by using the belt which is not shown in the drawing but is attached to the body of it. The electronic timepiece 1 comprises a generator system A, a power supply system B, a control unit C, and a motor unit D. The generator system A generates alternating current. The power supply system B rectifies the alternating current to generate the direct current, then introduces the direct current into a battery unit 48, and then raises or lowers the stored voltage of the battery unit, and then supplies the voltage thus raised or lowered to circuits in the timepiece. The control unit C controls the overal operation of the timepiece. The motor unit D drives a stepping motor 10 which drives a second hand 61, a minute hand 62, and a hour hand 63.

The generating apparatus 40 is an electromagnetic induction type AC generator for example. The generator system A comprises a generating apparatus 40, an oscillating weight 45, and an acceleration gear 46. The oscillating weight 45 is driven to rotate by movement of user's arm. The movement of the oscillating weight 45, via the acceleration gear 46, is transmitted to a generator rotor 43. The generator rotor 43 rotates in a generator stator 42. Then electricity is induced in a coil 44.

The power supply system B comprises a rectifier circuit 47, a battery unit 48, and a voltage raising and lowering circuit 49. The rectifier circuit 47 rectifies alternating current which comes from the generator system A. The battery unit 48 comprises a capacitor or a chargeable battery such as lithium battery. The rectified current, from the rectifier circuit 47 flows into a positive electrode of the battery unit 48.

The current is output from a negative electrode of the battery unit and returned to the rectifier circuit. The battery unit 48 stores the current thus supplied. The voltage raising and lowering circuit 49 uses more than one capacitors to raise or lower the stored voltage of battery unit 48 multiple times. The output voltage of the voltage raising and lowering circuit 49 is controllable by a control signal ϕ11 from the control unit C.

In FIG. 1, the positive electrode of the battery 48 and the GND terminal of the voltage raising and lowering circuit 49 are connect to a ground line. The electronic potential of the ground line is defined as VDD (=0V). The negative electrode of the battery 48 is used as output terminal of the stored voltage VTKN of the battery. The raising and lowering circuit 49 raises and lowers the voltage VTKN to output the voltage VSS between the output, terminal of it and the GND terminal. The output voltage VSS of the raising and lowering circuit 49 is defined as a second lower electric potential side voltage VSS. The output voltage between both ends of the generating apparatus 40 is input to the control unit C as a control signal ϕ 13. The voltage VSS is input to the control unit C as a control signal ϕ 12.

The motor drive circuit E generates a drive pulse based on a drive clock provided from the control unit C, and then provides the drive pulse lo a stepping motor 10 in the motor unit D. The stepping motor 10 rotates in accordance to a number of the drive pulse. A rotating part of the stepping motor 10 is connected to a second intermediate wheel 51 via a pinion. Therefore the rotation of the stepping motor 10 is transmitted to the second hand 61 by way of the second intermediate wheel 61 and the second wheel 52. Then the second indication is conducted. Furthermore, the rotation of the second wheel 52 is transmitted to a minute intermediate wheel 53, a minute wheel 54, a minute wheel 55, and a hour wheel 56. The minute wheel is connected to a minute hand 62. The hour wheel is connected to a hour hand 63. Therefore these hands works together with the rotation of the stepping motor 10 so that hour and minute indications are conducted.

It is possible to connect other transmission system to the gear train 50 to display calendar and so on. For example, in order to display date, we can put, a intermediate date wheel, and a date disc and so on. And moreover we can put a calendar correction gear train (such as a first calendar correction wheel, a second calendar correction wheel, a calendar correction wheel, and a date disc).

Figure 2:
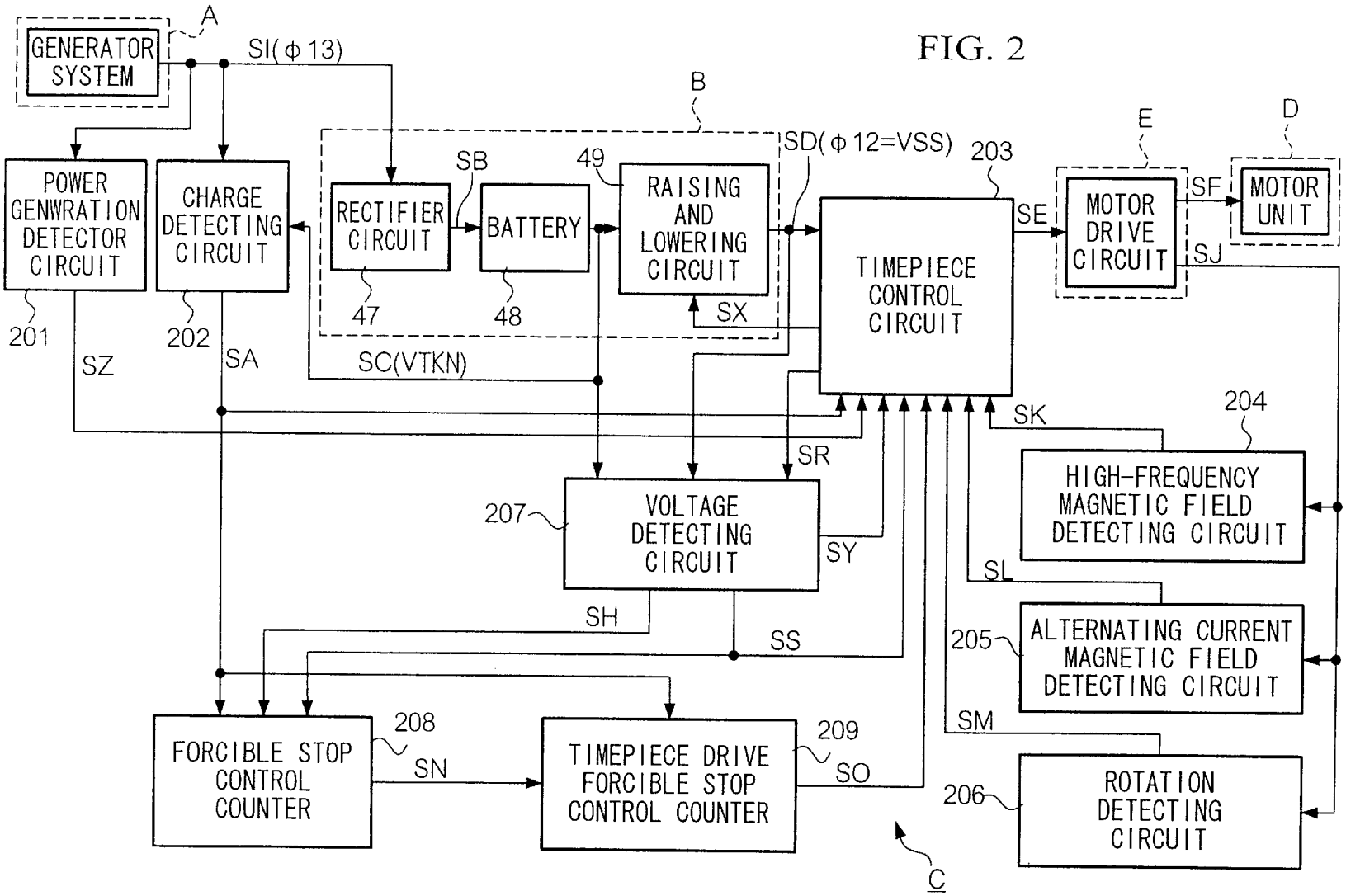
FIG. 2 is a block diagram which shows constructions of each part of the timepiece of FIG. 1.

Referring now to FIG. 2, the detail description with respect to each structure of the timepiece in FIG. 1 will be given. FIG. 2 is a block diagram which shows detail of the control unit C of FIG. 1 and shows signal flows between units from A through E in the preferred embodiment of the present invention. In FIG. 2, blocks of from 201 to 209 are circuit blocks in the control unit C, and those surrounded by broken lines are not.

The power generation detector circuit 201 detects the generation by the generator system A based on a generated voltage signal SI. The generated voltage signal SI indicates the voltage ϕ 13 between output; terminals of the system A. The circuit 201 outputs a power generation detect signal SZ indicating whether or not the voltage is generated by the generator system A. The circuit 201 comprises a comparator circuit which compares the generated voltage signal SI with a prefixed reference voltage Vref. When the level of voltage SI is higher than the prefixed reference voltage Vref, the circuit 201 outputs a generation detect signal SZ having high level.

A charge detector circuits 202, by using the generated voltage signal SI and the stored voltage signal SC indicating the stored voltage VTKN of the battery detects whether or not the generator system A is in a state which is capable of charging the battery 48. The the circuit 202 outputs the detected result as a charge detect signal SA.

The circuit 202 comprises a comparator circuit which compares the generated voltage signal SI with the stored voltage signal SC. When the level of generated voltage signal SI is larger than the level of stored voltage signal SC, the circuit 202 outputs the charging detect signal SA having high level.

Figure 3A:
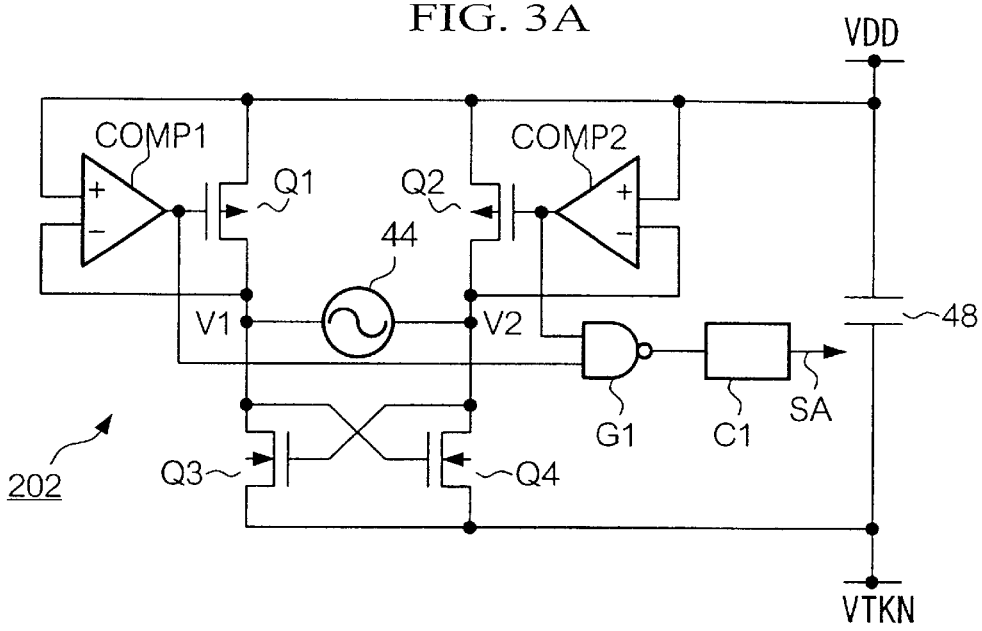
FIG. 3 is a circuit diagram which shows two example (a) and (b) compositions of the charge detector circuit 202.
Figure 3B:
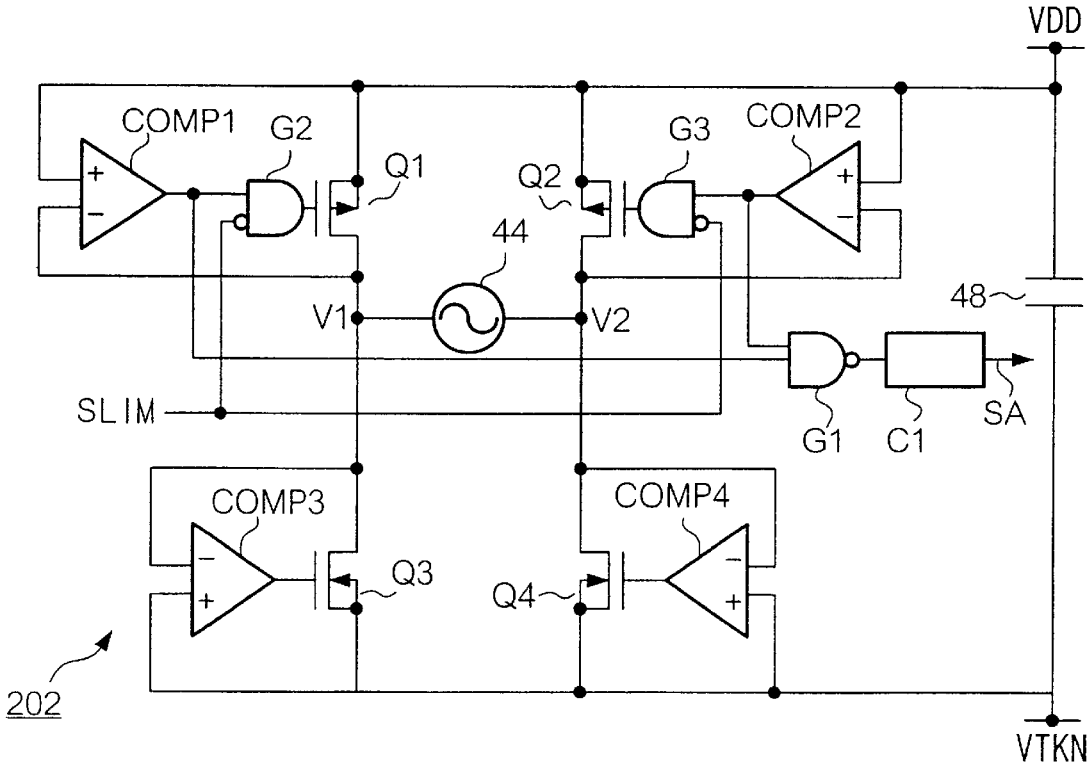

FIGS. 3A and 3B show two examples of composition of the charge detector circuit 202.

FIG. 3A is a circuit diagram showing the configuration of the first example of the circuit 202. The circuit 202 comprises first and second comparators of COMP1 and COMP2, a first, second, third, and 4th transistors of Q1, Q2, Q3 and Q4, a NAND circuit GI, and a smoothing circuit C1. Drain electrodes of transistors Q1 and Q3 are commonly connected to one terminal of the generator coil 44. Drain electrodes of transistors Q2 and Q4 are commonly connected to another terminal of the generator coil 44. Source electrodes of transistors Q1 and Q2 are commonly connected to the positive electrode of the battery 48. Source electrodes of transistors Q3 and Q4 are commonly connected to the negative electrode of the battery 48.

In the preferred embodiment, the electronic potentials of the positive and negative electrodes of the battery 48 are respectively defined as VDD (=0V) and VTKN (hereinafter, referred as to voltages VDD and VTKN). The electronic potentials of two terminals of the generator coil 44 are defined as V1 and V2 (hereinafter, refurred as to voltages V1 and V2).

The first comparator COMP1 compares the voltage V1 of one output terminal of the generator coil 44 (shown in FIG. 1) with the voltage VDD. The comparator switches on and off the first transistor Q1 based on the comparison result. The second comparator COMP2 compares the voltage V2 of other output terminal of the coil 44 with the voltage VDD. The comparator switches on and off the second transistor Q2 based on the comparison result. The third transistor Q3 is inserted between the negative electrode (having the voltage VTKN) of the battery 48 and one output terminal of the generator coil 44 as an active load. The fourth transistor Q4 is inserted between the negative electrode (having the voltage VTKN) of the battery 48 and other output terminal of the generator coil 44 as an active load. The output signals of the first and the second comparators are input to the NAND circuit G1. The smoothing circuit C1 flattens the output, signal of the NAND G1 to generate a charge detect signal SA.

Next, the operation of the first example will be described.

First, the description will be given with respect to an operation when the absolute value of the voltage V1−V2 generated between the two terminals of the generator coil 44 is lower than the absolute value of the stored voltage VTKN of the battery 48, and is not, high enough to charge the battery 48. In this case, the output signals of the first and the second comparator are high level. So both the first and the second transistors are not set on. Therefore no current flows and charging of the battery 48 is not performed.

Next, suppose a case in which the absolute value of the voltage, V1−V2 generated between the two terminals of the generator coil 44 becomes higher, and the peak of the absolute value exceeds the absolute value of the stored voltage VTKN of the battery 48, and is high enough to charge the battery 48. In this case, there are two states of the one V1>V2 and the other V2>V1. When V1 is higher than V2, the first comparator COMP1 outputs low level signal, then a current flows from generator coil 44, then to the first transistor Q1, then to the battery 48, then to the fourth transistor Q4. On the other hand, when V2 is higher than V1, the second comparator COMP2 outputs low level signal, then a current flows from generator coil 44, then to the second transistor Q2, then to the battery 48, then to the third transistor Q3.

As described above, when the absolute value of the peak voltage generated by the generator coil 44 is enough high and one of the output signals of the first or the second comparator is low, the output signal of NAND circuit G1 becomes high level. The output signal of the NAND circuit GI is flattered to generate, the charge detect signal SA.

FIG. 3B is a circuit diagram showing the configuration of the second example of the charge detector circuit 202 in FIG. 2. The circuit 202 in FIG. 3B is different from the one in FIG. 3A in having third and fourth comparators of COMP3 and COMP4, and two double-input AND gate G2 and G3. The third comparator COMP3 compares the voltage VTKN with V1 which is the voltage of one output terminal of the generator coil 44. Then the comparator supplies the output signal indicating the comparison result to the gate of the transistor Q3. The fourth comparator COMP4 compares the voltage VTKN with V2 which is the voltage of another output terminal of the generator coil 44.

Then the comparator supplies the output signal indicating the comparison result to the gate of the transistor Q4. The double input AND gates G2 and G3 have an active high input terminal and an active low input terminal. The output signal of the first comparator COMP1 is supplied to the active high input terminal of the AND gate G2. The output signal of the second comparator COMP2 is supplied to the active high input terminal of the AND gate G3. An over-charging prevention control signal SLIM is supplied to the low active input terminals of the AND gates G2 and G3. The over-charging prevention control signal SLIM is a signal generated by a timepiece control circuit 203 or a voltage detecting circuit 207. When the stored voltage of the battery 48 exceeds a predetermined allowable voltage of the battery, the signal SLIM becomes high level. When the stored voltage of the battery 48 is lower than a predetermined allowable voltage, the signal SLIM is low level. When the signal SLIM is low level, the charge detector circuit, 202 in FIG. 3B acts in the same way as the circuit in FIG. 3A.

That is, the circuit 202 in FIG. 23B makes the charge detect signal SA high level when detecting the charging of the battery 48. On the other hand, when the signal SLIM is high level, the double input gate AND G2 and G3 become low level and then the first and the second transistor Q1 and Q2 become on. Therefore the terminals on the both end of the generator coil 44 are short-circuited, hence the battery 48 is not charged.

In FIG. 2, the rectifier 47 gives a full-wave rectified voltage of the voltage SI as a rectification output signal SB to the battery unit 48. The stored voltage VRKN of the battery unit 48 is raised and lowered by the raising and lowering circuit 49. The result of this raising and lowering is provided to the timepiece control circuit 203 as a stored voltage raising and lowering result signal SD.

The timepiece control circuit 203 comprises an oscillator circuit, a frequency divider circuit, and a signal processing circuit (such as a CPU (central processing unit)). The oscillator circuit is a quartz crystal oscillator for example. The frequency divider circuit divides the output signal of the oscillator circuit,. The signal processing unit, based on the output signal of the divider circuit, generates several control signals for each components. The control signals include a motor driving control signal SE. The motor driving circuit E uses a voltage between VSS and VDD as a power source and generates a motor driving signal SF for the motor unit D based on the motor driving control signal SE. That is, the motor driving control signal SE is a control signal for controlling the generation of the motor driving control signal SF by the motor driving circuit E. Under the control based on the motor driving control signal SE, the motor driving circuit E generates, as the motor driving control signal SF, a normal driving pulse, a rotation detect pulse, a high frequency magnetic field detect pulse, a magnetic field detect pulse, and a auxiliary pulse and so on. The normal driving pulse is generated when driving the motor of the motor unit D in a normal operation. The rotation detect pulse is generated when detecting if the motor of the motor unit D) is rotating or not. The high frequency magnetic field detect pulse is generated to detect if the high frequency magnetic field is generated or not. The magnetic field detect pulse is generated in detecting an external magnetic field. The auxiliary pulse has higher effective electric power than the normal driving pulse. The auxiliary pulse is generated when the motor unit D fails to rotate by the normal driving pulse.

A high frequency magnetic field detecting circuit 204, an alternating magnetic field detecting circuit 205, and a rotation detecting circuit 206 are circuits to detect existences of high frequency magnetic field, alternating magnetic field, and rotation of driving rotor of the stepping motor 10 respectively.

When the high frequency magnetic field detect pulse drives the motor unit D, the high frequency magnetic field detecting circuit 204 compares an alternating voltage SJ induced in the motor coil of the motor 10 with a predetermined reference voltage to detect the existence of a high frequency magnetic field.

When the alternating magnetic field detect pulse drives the motor unit D, the alternating magnetic field detecting circuit 205 compares the induced alternating voltage SJ with a predetermined reference voltage to detect the existence of a high frequency alternating magnetic field.

When the rotation detect pulse drives the motor unit D, the rotation detecting circuit 206 compares the induced alternating voltage SJ with a predetermined reference voltage to detect the existence of a rotation of driving rotor of the stepping motor 10.

The detected results of the high frequency magnetic field detecting circuit 204, the alternating magnetic field detecting circuit 205, and the rotation detecting circuit 206 are input to the timepiece control circuit 203 as a high frequency magnetic field detect, result, signal SK, an alternating magnetic field detect result, signal SL, and a rotation detecting circuit, result signal SM.

The voltage detecting circuit 207 receives the stored voltage signal SC (indicating the stored voltage VTKN) at a moment, of the voltage detect control signal SR, then compares the signal SC with first, second, and third predetermined voltage of VBLD, VOFF, and VON, all of which are later explained, and several predetermined comparing voltages including indicator display switching voltages of VINDA, VINDB, and VINDC, all of them are also later explained. The circuit 207 then outputs a timepiece movement forcible stop detect signal SH, a voltage detect result signal SS, a comparison result signal SY respectively indicating the results of comparison. The timepiece movement forcible stop detect signal SH is a result signal indicating the result of comparison between the stored voltage signal SC and the second pre-determined voltage of VOFF. When the voltage VTKN is higher than the voltage VBLD, the signal SH has high level. The voltage detect, result signal SS indicates the result of comparison between stored voltage signal SC and the first predetermined voltage of VBLD. When the voltage VTKN is higher than the voltage VOFF, the signal SS has high level.

In another embodiment of the present invention, instead of the stored signal SC, the stored voltage raising and lowering result signal SD may be compared with the voltages VBLD, VOFF, and VON to obtain the signals SH, SS and SY. For example, when the absolute value of VTKN equals 0.625 V. (=VBLD) and the ratio of raising and lowering circuit 49 is 2, detecting the absolute value of VSS of 1.25 V. gives an equivalence. In this embodiment, the stored voltage signal SC indicating the stored voltage VTKN is used.

When the signal SH becomes low level, a forcible stop control counter 208 starts keeping time of this condition, based on the charging detect result signal SA, timepiece drive forcible stop detect signal SH, and voltage detect result signal SS. When a predetermined time has passed, the counter 208 outputs a counter output signal SN of having high level for forcible stop control. A timepiece drive forcible stop control circuit 209 receives the charge detect signal SA and the counter output, Signal SN for forcible stop control, then outputs a timepiece drive forcible stop signal SO. When the signal SO has a high level, the forcible stop control on the timepiece movement will be placed.

Figure 4:
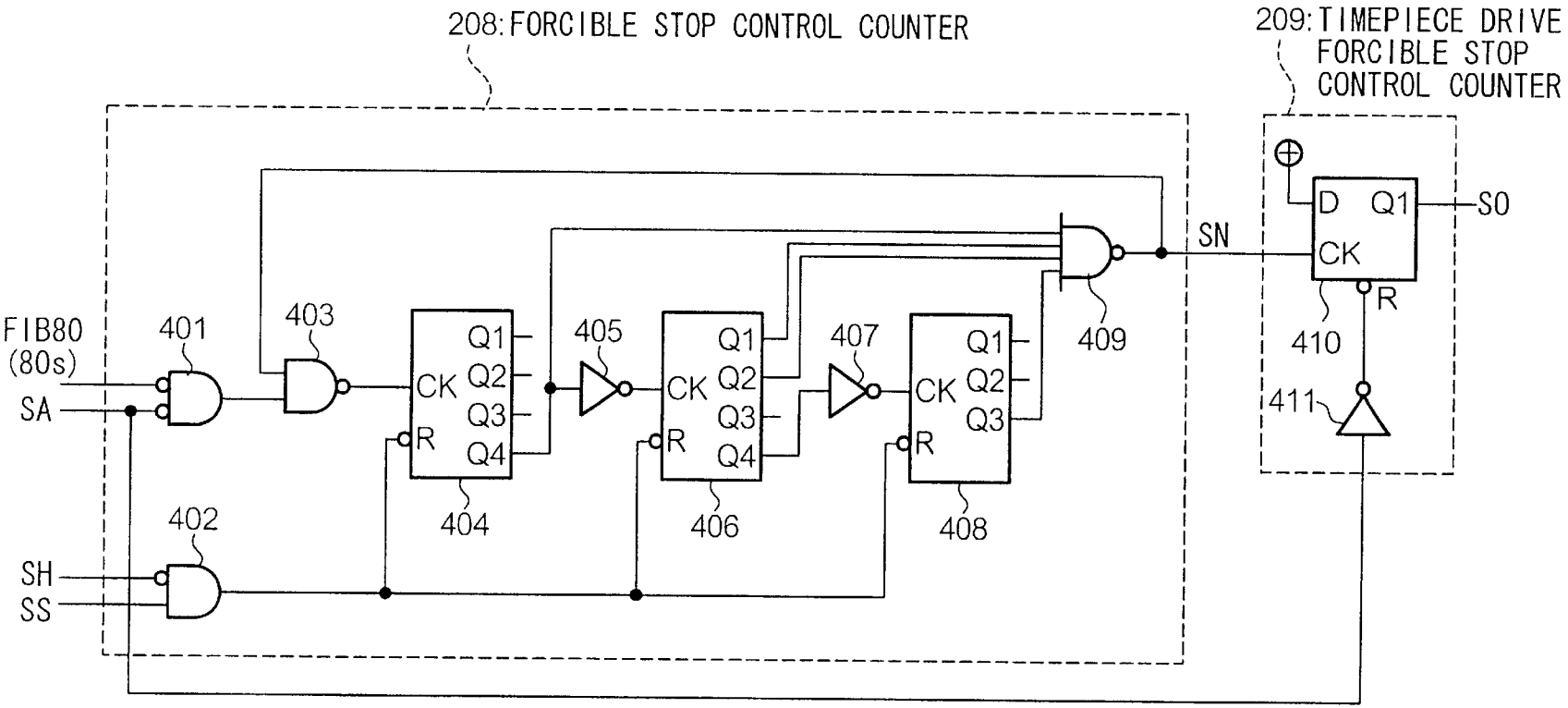
FIG. 4 is a circuit diagram which shows the compositions of the forcible stop control counter 208 and the timepiece drive forcible stop control circuit 209 shown in FIG. 2.

Referring now to FIG. 4, there is shown a circuit diagram showing the compositions of the forcible stop control counter 208 and the timepiece drive forcible stop control circuit 209. The forcible stop control counter 208 comprises a double-negative-input AND (NOR) 401, a double-input NAND 402, a double-input NAND 403, a quad-input NAND 409, counters 404, 406, and 408, and inverters 405 and 407. The double-negative-input AND (NOR) 401 receives a clock FIB80 which is generated by the frequency divider circuit in the timepiece control circuit 203 at a period of 80 seconds, and the charge detect signal SA. Both signals enters as a negative logic signal (active low signal). The double-input AND 402 receives the negative logic of the timepiece movement forcible stop detect signal S14, and the voltage detect result signal SS. The double-input NAND 403 receives the output signal of the AND 401, and an output signal of the NAND 409 which is later explained. The counters 404 and 406 are 4-bit counters. The counter 408 is a 3-bit counter. An output of the NAN) 403 is put into the clock input terminal of the counter 404. A bit Q4 of the counter 404 ($2^3$ bit) is inverted by the inverter 405, then is put into the counter 406 as a clock signal A bit Q4 of the counter 406 is inverted by the inverter 407, then is put into the counter 408 as a clock signal. An output signal of the AND 402 is put into the reset terminals of the counters 404, 406, and 408. The counters 404, 406, and 408 are reset when the output signal of the AND 402 is low. The NAN) 409 receives the bit Q4 of the counter 404, the bit Q1 ($2^0$ bit) of the counter 406, the bit Q2 ($2^1$ bit) of the counter 406, and the bit Q3 ($2^2$ bit) of the counter 408. The NAND 409 receives the output signals of the counters 404, 406, and 408, and when the counters reach the pre-fixed state, the NAND 409 outputs the counter output signal SN for forcible stop control.

In this configuration, when the timepiece movement forcible stop detect signal SH has high level, or the voltage detect result signal SS has low level, all the counters 404, 406, and 408 are reset. When the signal SH has low level, and the signal SS has high level, the reset is cancelled. Three counters of 404, 406, and 408 conduct a counting the clock FIB80 when the charge detect signal SA has low level. When the signal SA has high level, the output signal of the AN) 401 is fixed at high level, hence the counting process will stop. When the output signal of the NAND 409 has low level, the output signal of the NAND 403 is low level, hence the counting process will stop.

The timepiece drive forcible stop control circuit 209 in FIG. 4 comprises a D flip-flop circuit 410, and an inverter 411. The D input terminal of the D flip-flop circuit 410 is fixed at high level. The inverter 411 inverts the charge detect signal SA, then gives it to the reset terminal R of the circuit 410. The active level for the reset terminal R is low level. Therefore, the D flip-flop circuit 410 is reset when a low level signal is supplied from the inverter 411 to the reset terminal R. When the clock. CK has low level, the circuit, 410 reads the input, signal to the input D terminal and out it as the timepiece drive forcible stop signal SO. Therefore when the signal SA has low level and the signal SN has low level, the D flip-flop circuit 209 outputs the timepiece drive forcible stop signal SO having high level. When the signal SN has high level, the signal SO remains the same before. When the signal SA has high level, the signal SO becomes low, and after this, when the signal SA becomes low, and after this, the signal SN has low level, the signal SO becomes high.

From here, by using FIG. 5 to FIG. 9, the description will be given with respect to the control methods for executing a forcible stop of timepiece and a reset operation of the forcible stop, which the present invention features.

Figure 5:
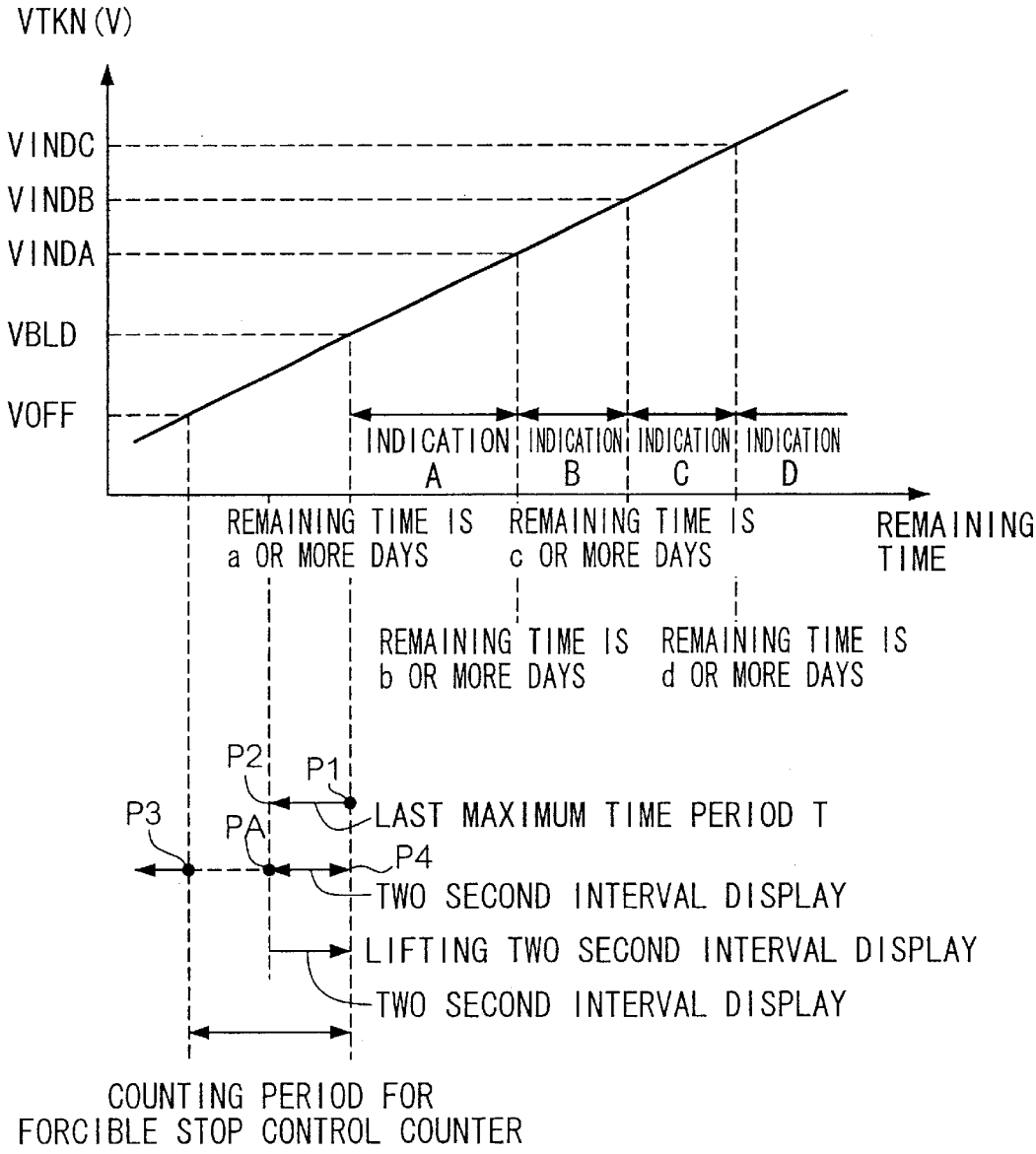
FIG. 5 is an explanatory drawing for the control method, which uses two pre-fixed first and second voltages as standard, of timepiece drive forcible stop control.
Figure 6:
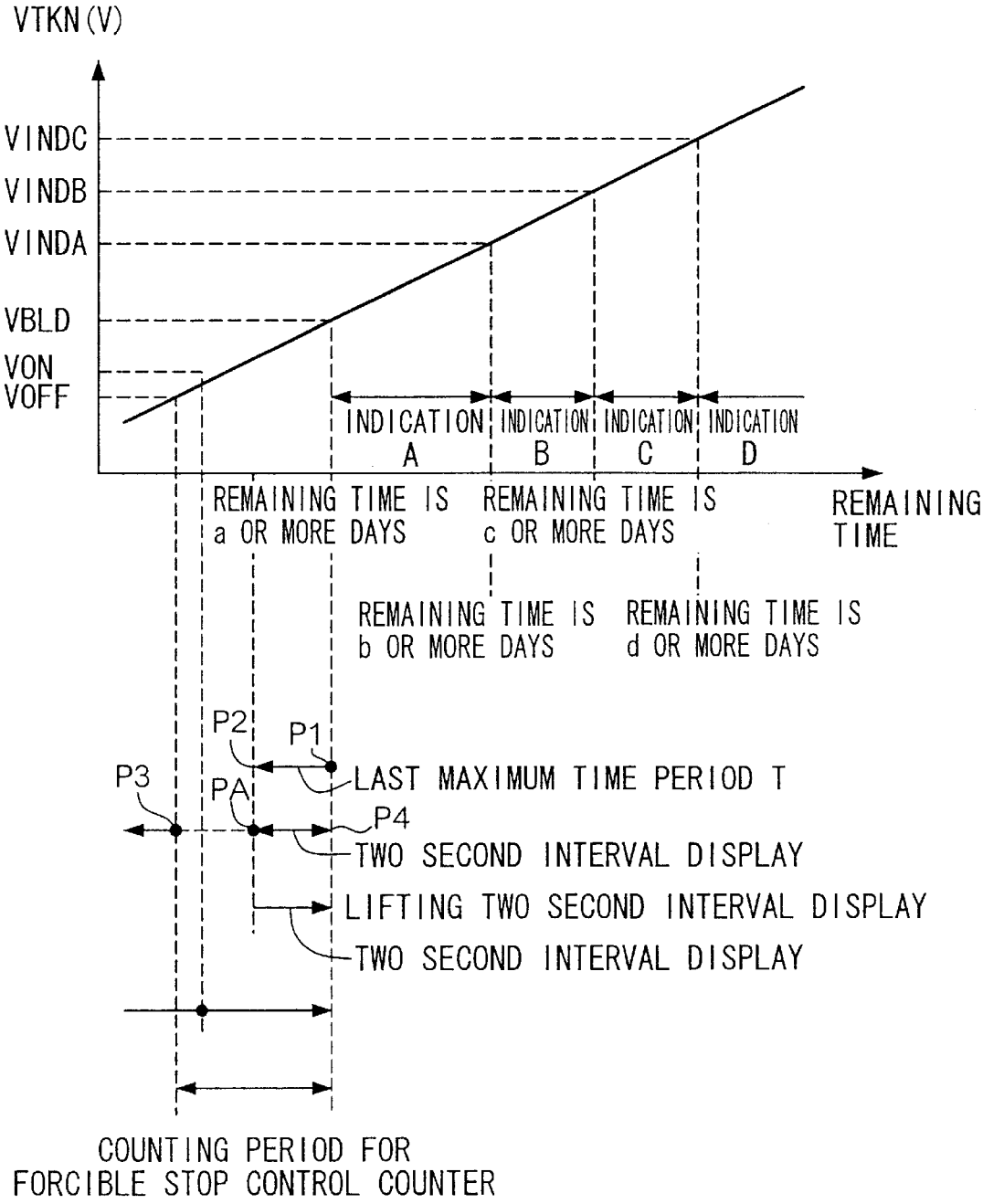
FIG. 6 is an explanatory drawing for the control method, which uses three pre-fixed first, second, and third voltages as standard, of timepiece drive forcible stop control.
Figure 7A:
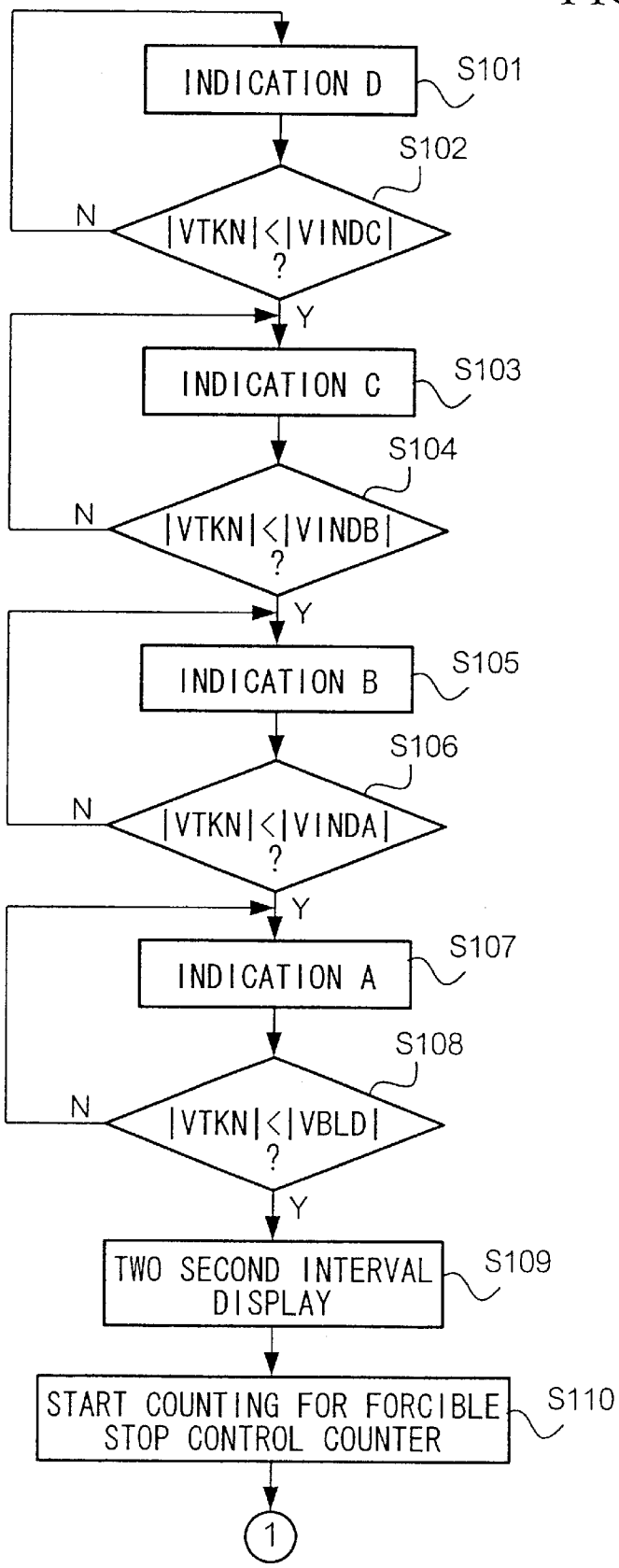
FIG. 7 is a flowchart which shows a process during forcible stop by the control method shown in FIGS. 5 and 6.
Figure 7B:
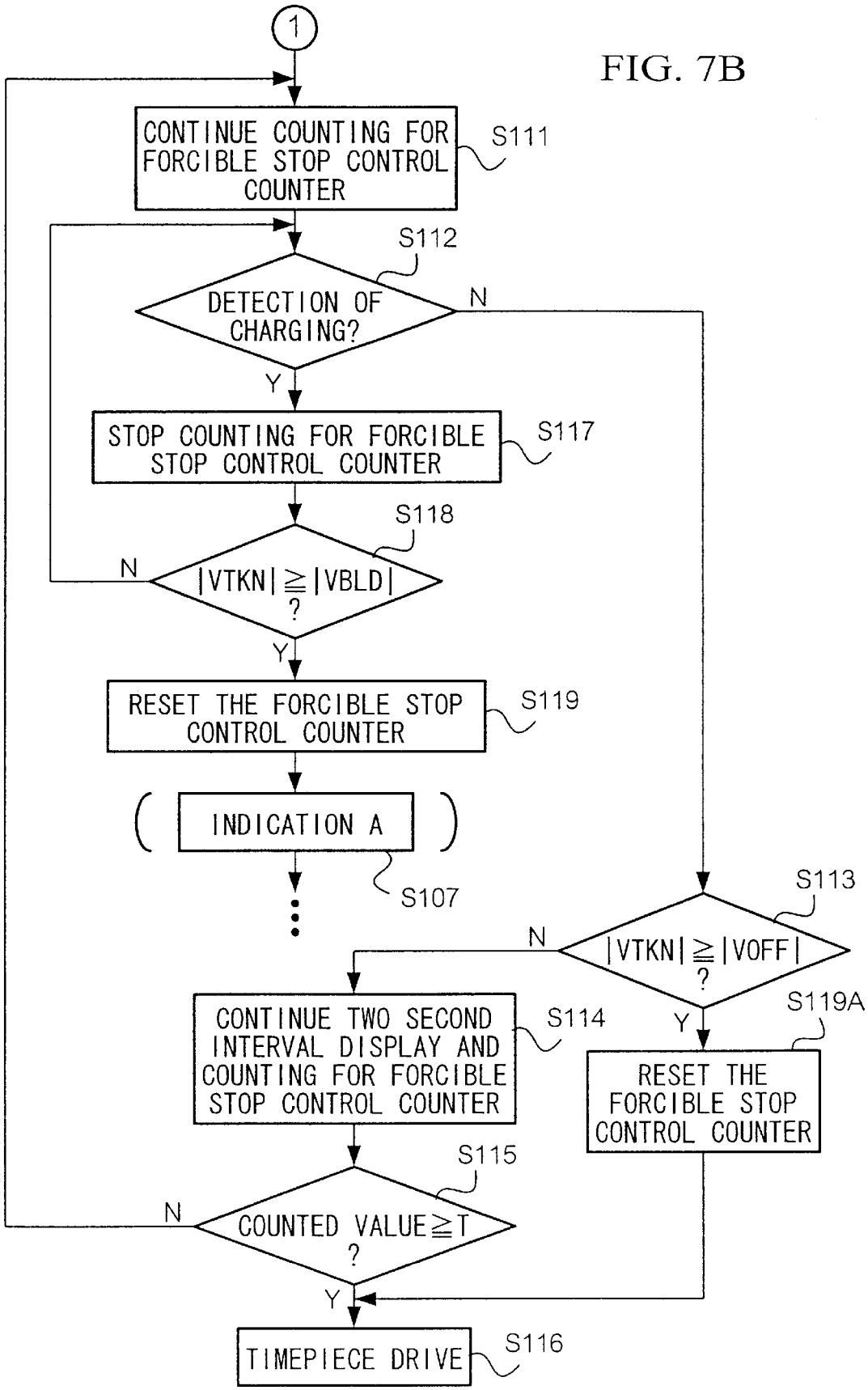
Figure 8:
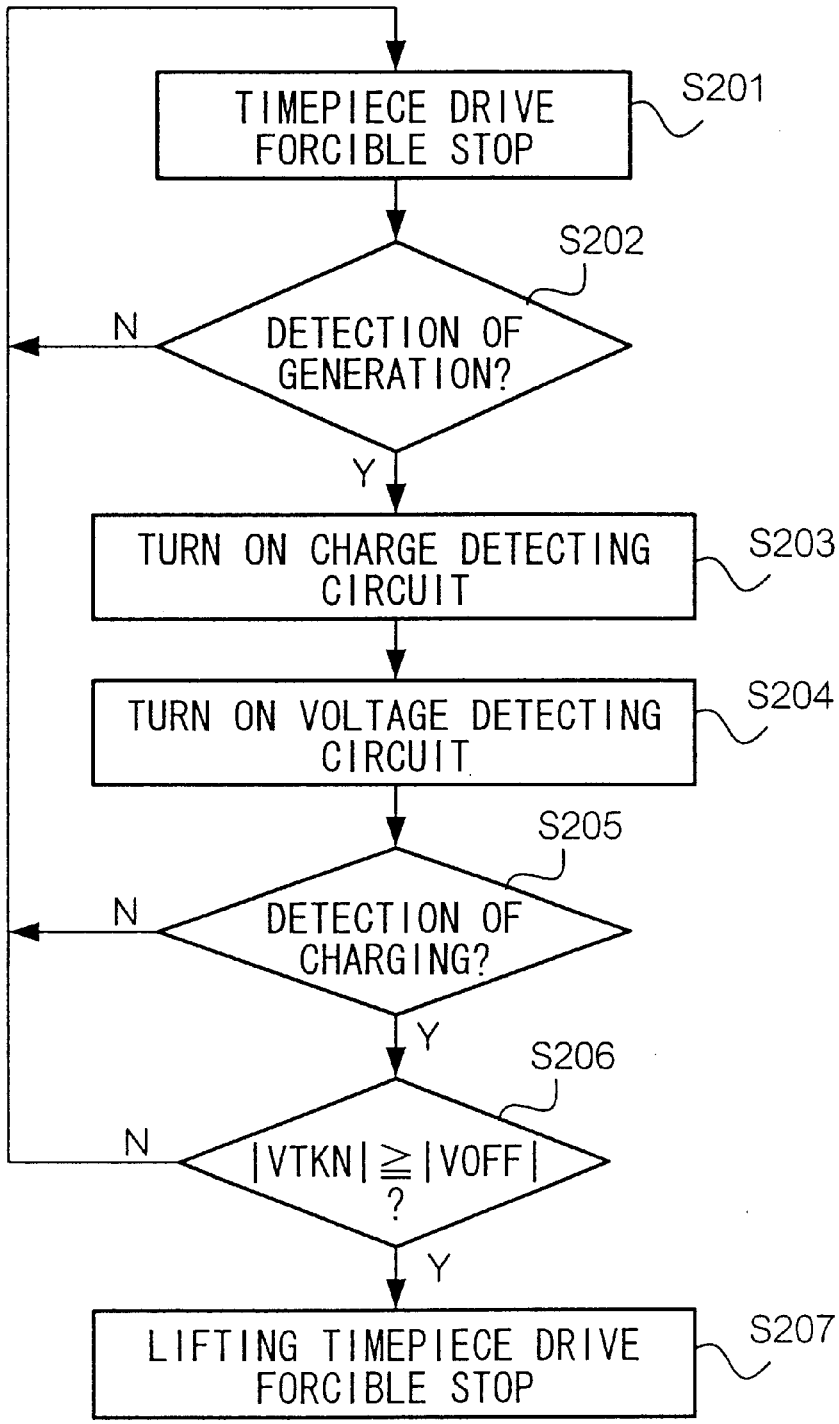
FIG. 8 is a flowchart which shows a process during forcible stop by the control method shown in FIG. 5.
Figure 9:
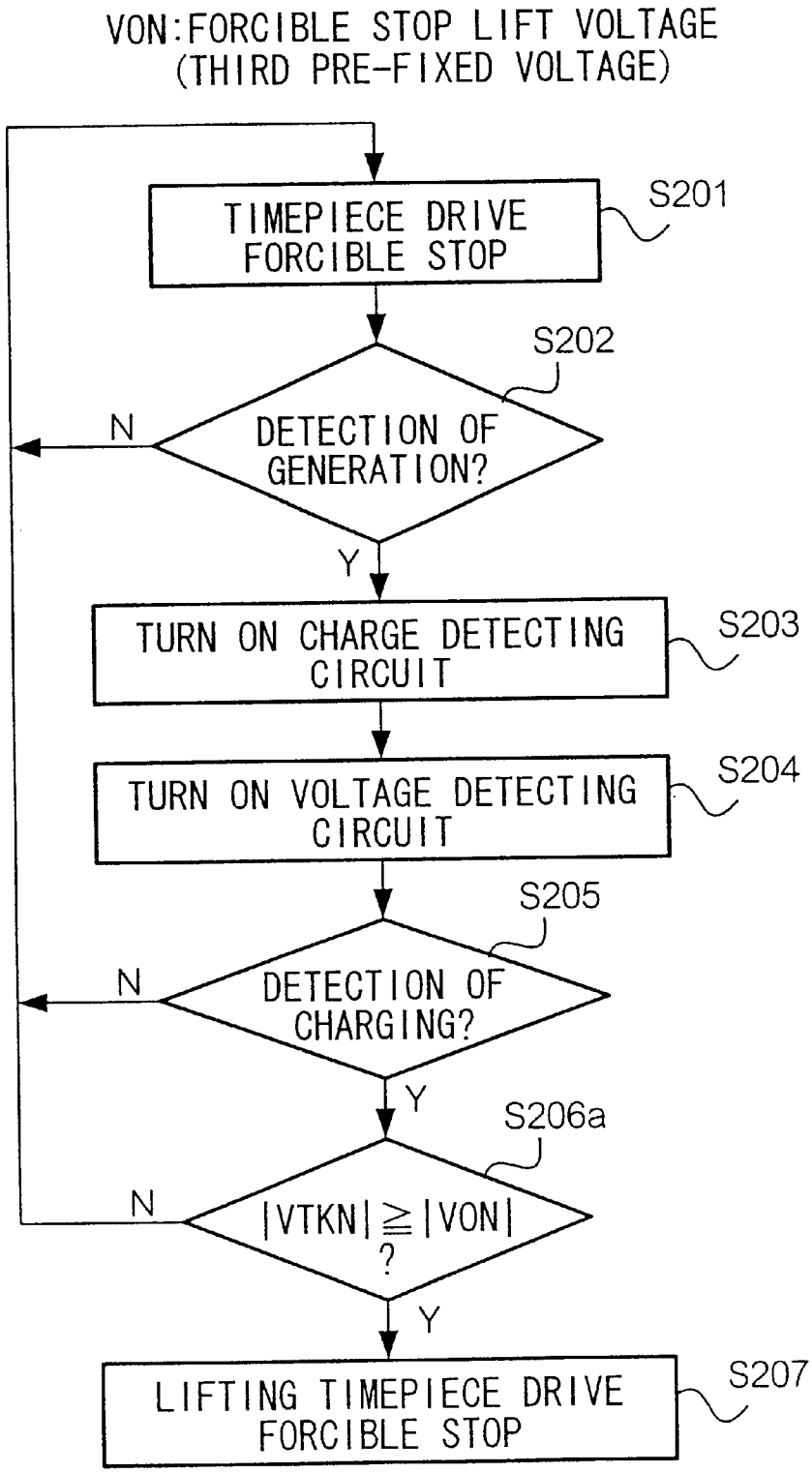
FIG. 9 is a flowchart which shows a process during forcible stop by the control method shown in FIG. 6.

FIG. 5 shows a first example of the method. In the first example, first and second voltages of VBLD and VOFF are used as reference voltages for controlling the forcible stop. FIG. 6 shows a second example of the method. In the second example, first, second and third voltages of V-BLD, VOFF, and VON are used as reference voltages for controlling the forcible stop. FIGS. 7A and 7B constitute a flowchart which shows a process in which the forcible stop is performed according to the control methods shown in FIGS. 5 and 6. FIG. 8 shows a flowchart which shows a process in which the forcible stop is reset according to the first example of the control method shown in FIG. 5. FIG. 9 shows a flowchart which shows a process in which the forcible stop is reset according to the second example of the control method shown in FIG. 6.

First of all, the first example will be described. In FIG. 5, when the stored voltage VTKN of the battery 48 is higher than an indicator display change voltage VINDC, the timepiece control circuit 203 gives an indication D which means that the drive remaining time is longer than d days (process from S101 to S102 in FIG. 7A). This indication is shown on the display section or by making a second hand or other hand in a certain condition, in accordance to a user operation, automatically or constantly. When the voltage VTKN decreases and becomes lower than the voltage VINDC but higher than an indicator display change voltage VINDB, the circuit 203 gives an indication C which means that the drive remaining time is longer than c days (process from S103 to S104). When the voltage VTKN decreases further and becomes lower than the voltage VINDB but higher than an indicator display change voltage VINDA, the circuit 203 gives an indication B which means that the drive remaining time is longer than b days (process from S105 to S106). When the voltage VTKN decreases still further and becomes lower than the voltage VINDA but higher than the first pre-fixed voltage VBLD, the circuit 203 gives an indication A which means that the drive remaining time is longer than a days (process from S107 to S108).

When further the voltage VTKN decreases and becomes lower than the first pre-fixed voltage VBLD, then the displaying method will be changed into other state which shows the user that there is even lesser remaining time (process S109 in FIG. 7A). In this displaying state, the second hand moves at two second intervals. At this stage, the forcible stop control counter 208 in FIG. 2 starts counting (process S110 in P1 of FIGS. 5 and 6). After the process of S110, the processes of S111, S112, S113, S114, and, S115 shown in FIG. 7B are repeatedly executed if the voltage VTKN is lower than the first voltage VBLD and higher than the second voltage VOFF, and the charging from the generating unit A to the battery 48 is not detected in S112. As a result, counting of the forcible stop control counter 208 proceeds (period until reaching the point PA or P2 in FIGS. 5 and 6). When the counting reaches a pre-fixed maximum continuous time T, the result of judgement in S115 shown in FIG. 7B becomes YES. As a result, the routine proceeds to S116, and in S116, a control to execute a forcible stop for time keeping operation is conducted (P3A or P2 in FIGS. 5 and 6). That is, timepiece drive forcible stop signal SO is changed to high level in S116.

On the other hand, when the voltage VTKN is lower than the first voltage VBLD and higher than the second voltage VOFF, and the counting by the forcible stop control counter 208 continues, the charging from the generating system A to the battery 48 may be detected. When the charging is detected, the counting is interrupted while there is charging (process from S111 to S112 to S117 to S118 to S112).

Furthermore, when the stored voltage VTKN is lower than the first pre-scribed voltage VBLD and higher than the second pre-scribed voltage VOFF, and counted value of the forcible stop control counter 208 is less than T seconds of maximum lasting time period, the stored voltage VTKN may become lower than the second pre-scribed voltage VOFF and the voltage detection result signal SS may become low level. When the stored voltage VTKN becomes lower than VOFF, the forcible stop control counter 209 is reset, and time keeping operation is forcibly stopped (process from S111 to S112 to S113 to S119A to S116 P3 in FIGS. 5 and 6).

When the counting by the forcible stop control counter 208 is in progress and the stored voltage VTKN becomes larger than the first pre-fixed voltage VBLD, the timepiece control circuit 203 puts the display state back to the indication A (process from S111 to S112 to S117 to S118 to S119 to S107, P4 in FIGS. 5 and 6).

Next, the control methods during lifting the forcible stop will be described with reference to FIG. 8 and FIG. 9. FIG. 8 shows the control process in which the first and second pre-fixed voltage of VBLD and VOFF are used as reference voltages for controlling the lifting of the forcible stop. FIG. 9 shows the control process in which the first, second, and third pre-fixed voltage of VBLD, VOFF, and VON are used as reference voltages for controlling the lifting of the forcible stop. The difference between the flowcharts of FIG. 8 and FIG. 9 is the voltage used as reference voltage in lifting the forcible stop (S206 in FIG. 8 and S206*a* in FIG. 9). Therefore the detail description of FIG. 9 is omitted.

In the flowchart of FIG. 8, at the state S201 when timepiece is in the forcible stop condition, the power generation detect signal SZ has high level. When the charging is detected (S202), the timepiece control circuit 203 lets the charge detector circuit 202 start detecting the charging (S203), and the voltage detecting circuit 207 start, measuring (S204). When the charge detect signal SA has high level and the charging is detected, the stored voltage VTKN is compared to the second pre-fixed voltage VOFF (S206). When the voltage VTKN is equal to or higher than the voltage VOFF, the forcible stop of timepiece movement is lifted (S205 to S206 to S207). On the other hand, when there is no detection of power generation at the step S202 or of charging at the step S205, or at the step S206 the voltage VTKN is lower than the voltage VOFF the forcible stop of timepiece movement is not lifted. Then the above mentioned control resumes at the stage of the timepiece drive forcible stop (S201).

Figure 10:
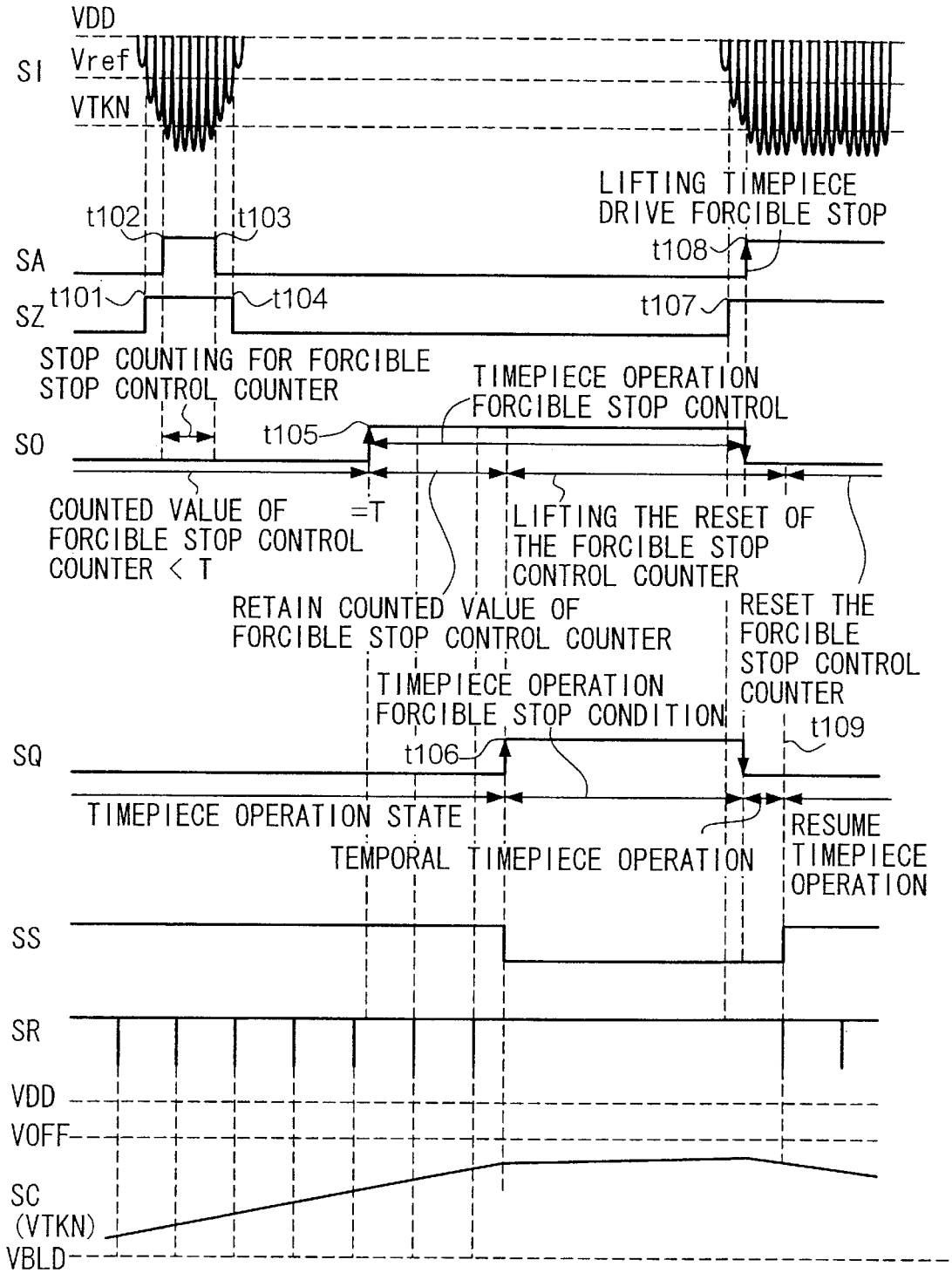
FIG. 10 is a timing chart which shows an operation by the control method shown in FIG. 5.
Figure 11:
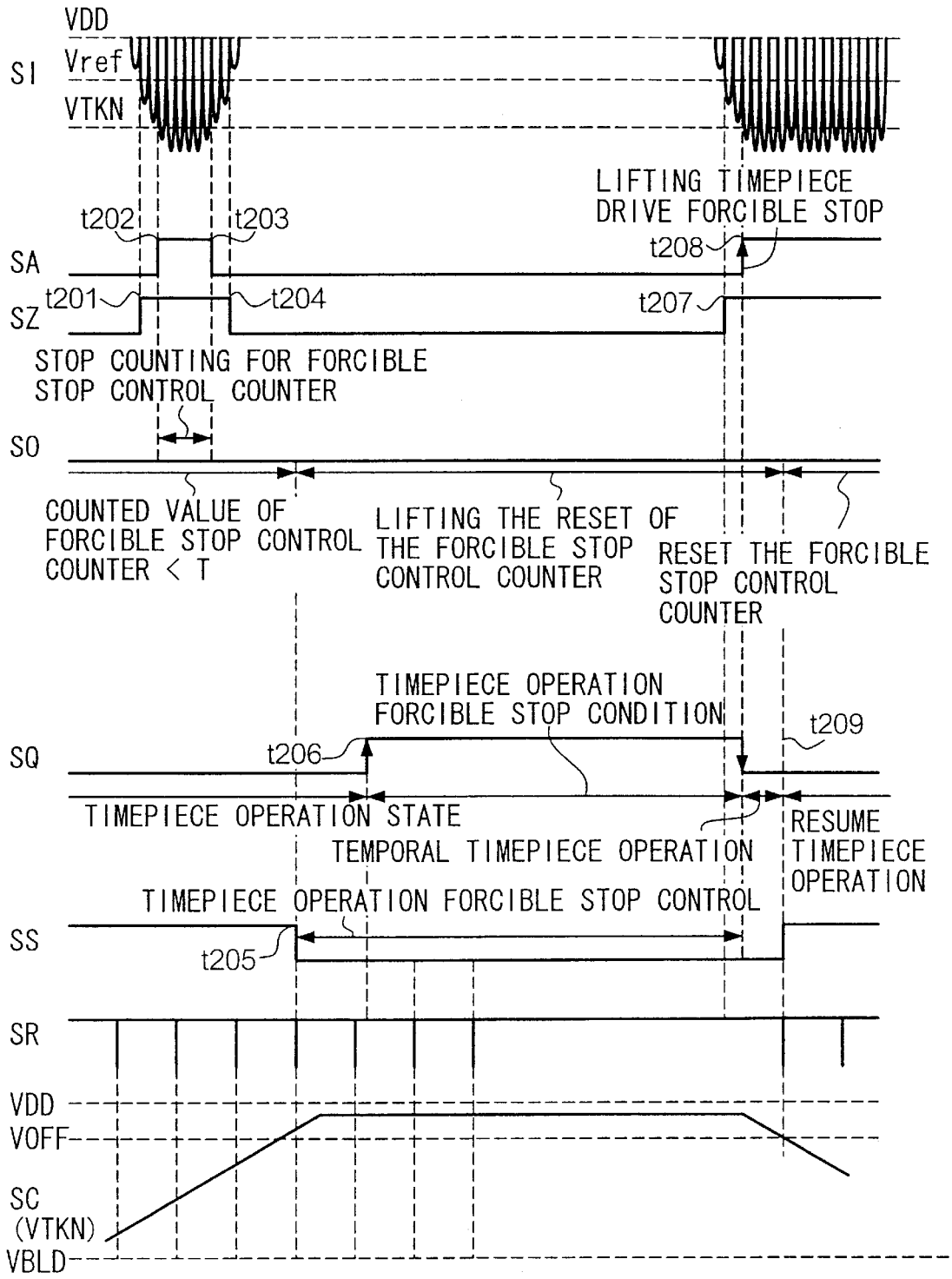
FIG. 11 is a timing chart which shows other operation by the control method shown in FIG. 5.
Figure 12:
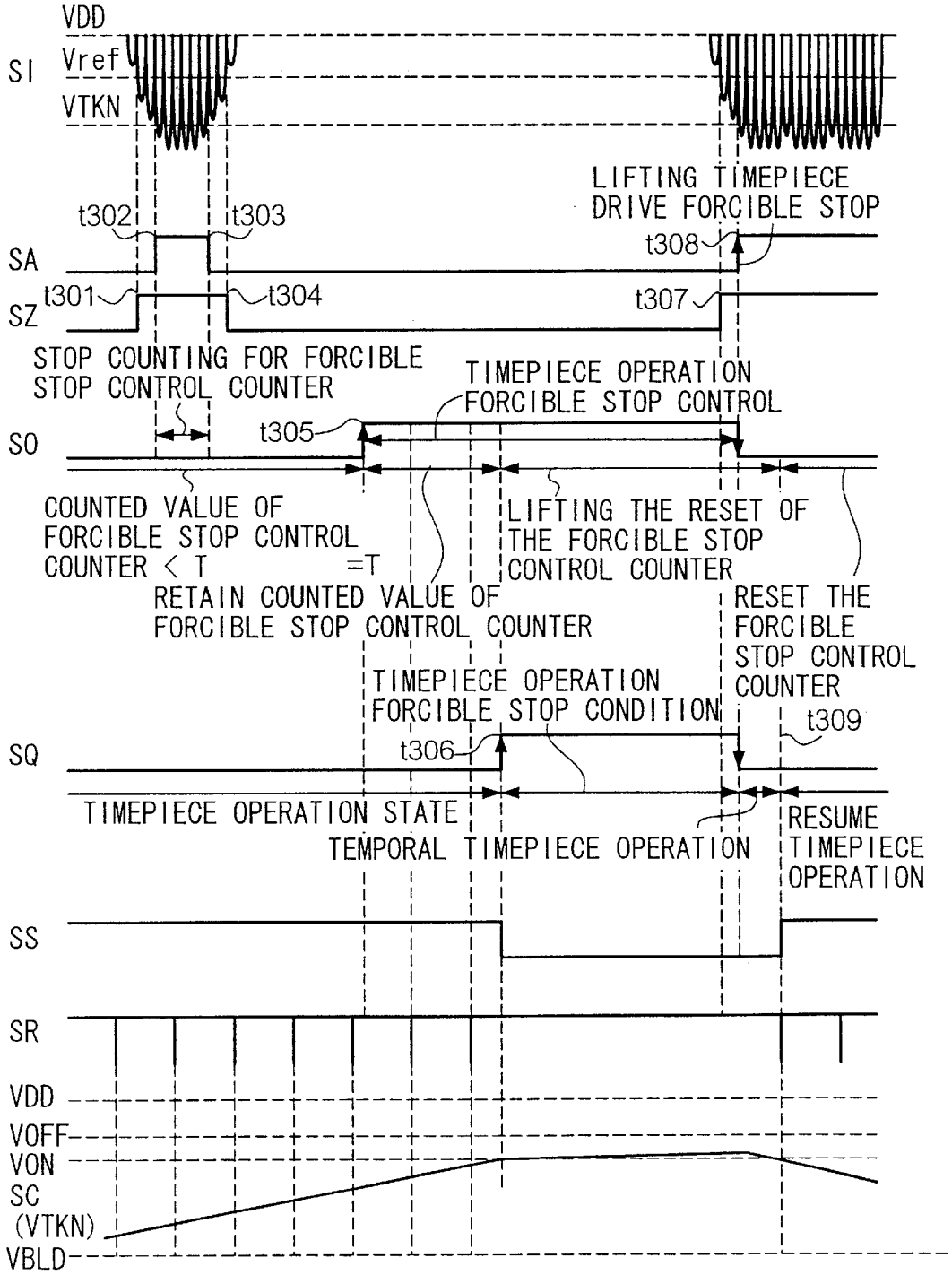
FIG. 12 is a timing chart which shows an operation by the control method shown in FIG. 6.
Figure 13:
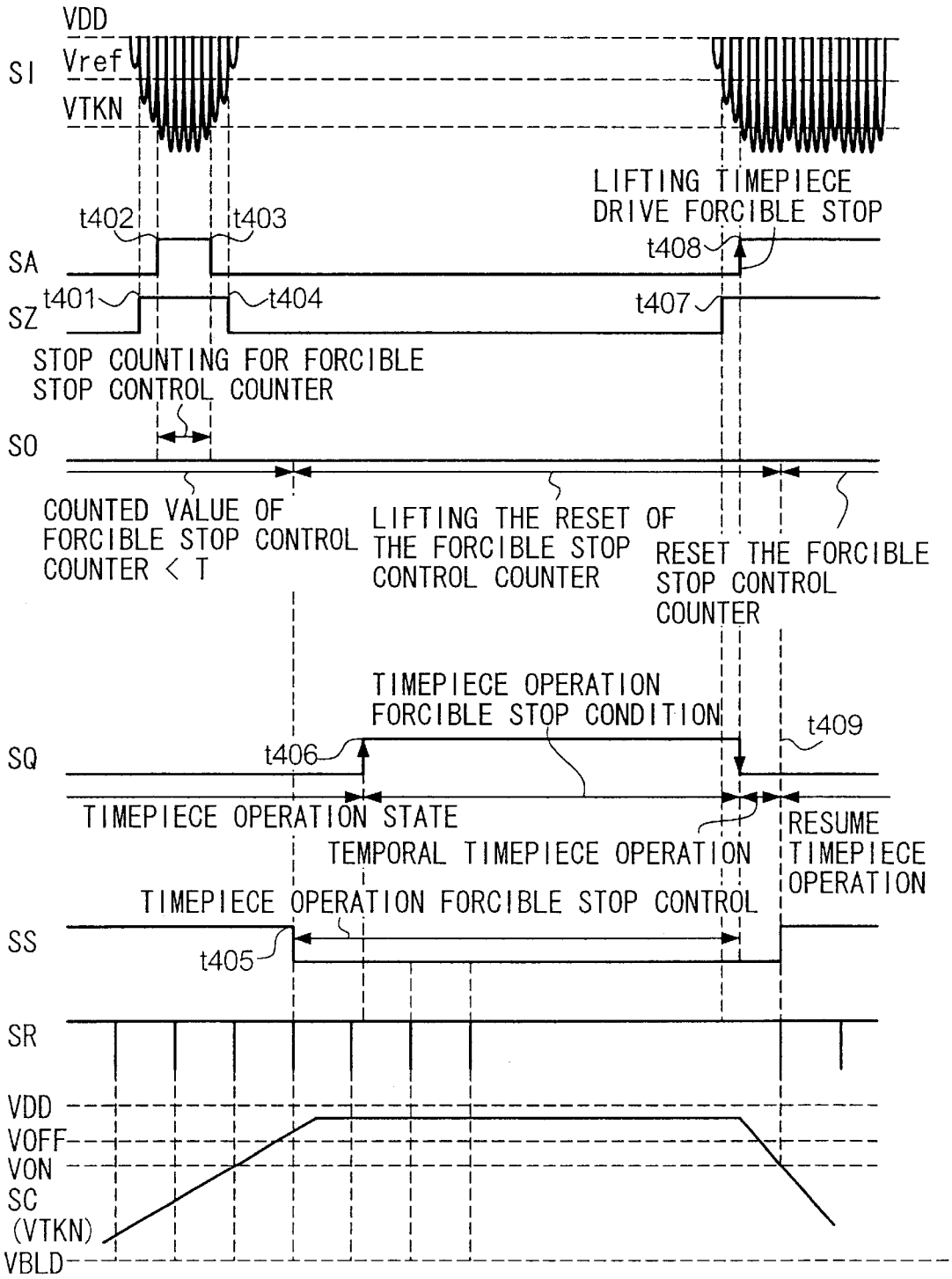
FIG. 13 is a timing chart which shows other operation by the control method shown in FIG. 6.

Next, with reference to timing charts in FIGS. 10–13, the description will be given with respect to an example of the operation of this embodiment. In FIGS. 10–13, the time goes by from left to right. FIGS. 10 and 11 show cases in which the, first and the second voltage are used as reference voltages. FIGS. 12 and 13 show cases in which the first, the second, and the third voltages are used as reference voltages. FIGS. 10–13 show the states of the following signals of S1, SZ, SA, SO, SS, SR, and SC shown in the block diagram of FIG. 2, and an oscillation stop detect signal SQ. The generated voltage signal SI indicates the voltage generated by the generator system A. The power generation detect signal SZ maintains high level during the generator system A is generating the voltage. The charge detect signal SA maintains high level during the charging of the battery 48.charge The timepiece drive forcible stop signal SO SS becomes high level when the timepiece drive is to be stopped. The voltage detect control signal SR is a negative pulse generated at a predetermined period. The signal SR is used as a sampling pulse for sampling the stored voltage signal SC which indicates the stored voltage. The oscillation stop detect signal SQ is the signal which shows that the circuit in the timepiece control circuit 203 stops. As shown in FIGS. 10–13, the period during which the signal SQ indicates the movement stop (SQ has high level) does not match the period during which the signal SO has high level and the period during which the signal SS has low level. This is due to movement delays which are determined by, for example, the clock timing, the stored voltage, or the composition of the circuit which is first put to stop after a forcible stop control signal is emitted.

Incidentally, FIGS. 10–13 show wave shape transformations for each parts when the voltage SI and SC are changed as parameters. The wave shape of the stored voltage SI shown in FIGS. 10–13 is the one after the process of the full-wave rectification.

In the examples shown in FIGS. 10–13, the stored voltage signal SC is lower than the first pre-fixed voltage VBLD. Hence, at the leftmost in the timing chart, the counting process is already under way.

First, the description will be given with respect to the example operation shown in FIG. 10. At all the period in FIG. 10, the stored voltage signal SC is not lower than the second pre-fixed voltage VOFF. During the period between t101 and t104, and after t107, the generated voltage signal SI is high enough to make: the power generation detect signal SZ have high level. During the period from t101 and t104 the signal SZ has high level, and during the period from t102 to t103 the charge detect signal SA has high level. Therefore during the period from t102 to t103 the forcible stop control counter 208 is not counting. At the time t105, the count value of the counter 208 reaches the pre-fixed time T. As a result, the timepiece drive forcible stop signal SO becomes high level. After this, the timepiece operation is in the forcible stop condition and the oscillation stop detect signal SQ becomes high level at t106. At the time t,106, although the stored voltage SC signal (VTKN) is not lower than the second pre-fixed voltage VOFF, the voltage detect result signal SS has low level. The reason for it is not explained above, but this is because the output circuit of the signal SS is constructed in order for the signal SS to have low level when each circuit is in the oscillation stop condition. During the period from t105 to t106, the count value of the counter 208 is held. During the period from t106 to t109, the counter 208 has been reset.

Then at the time t107, generation is detected (the power generation detect signal SZ has high level). As a result, the detection by the charge detecting circuit, 202 and the voltage detecting circuit 207 start. Then at the time t,108, when the charging is detected and the charge detect signal SA becomes high level, the timepiece drive forcible stop signal SO becomes low level, and the forcible stop control for the timepiece movement is lifted. However, at the time t108 the voltage detect result signal SS has low level. Next at the time t109 the voltage detect control signal SR becomes active (low level). As a result, the signal SS returns high level and the reset of the forcible stop control counter 208 is lifted. In this case, the signal SS returns high level at, the time t109. Hence, during the period from t108 to t109, due to the construction of the circuit for drive stop control, there are cases when the movement signal wave does not match the wave shown in this chart (temporal timepiece operation).

Next the description will be given with respect to the example operation shown in FIG. 11. In this example, during the period between t201 and t204, and after t207, the generated voltage SI is high enough to make the power generation detect signal SZ have high level. The stored voltage signal SC becomes lower than the second voltage (VOFF) just before the time t205, and becomes higher than the second voltage (VOFF) after the time t208 when the charging begins. During the period from t201 to t204 the signal SZ has high level, and during the period from t202 to t203 the charge detect signal SA has high level. Therefore during the period from t202 to t203 the forcible stop control counter 208 is not counting. At the time t205, the voltage detect control signal SR becomes active. As a result, the voltage detecting circuit 207 detects that the stored voltage signal SC is lower than the second pre-fixed voltage (VOFF). Therefore the voltage detect result signal SS becomes low level, and the forcible stop control for the timepiece operation starts, and the forcible stop control counter 208 is reset. Then at the time t206, the oscillation stop is detected, and the oscillation stop detect signal SQ becomes high level.

At the time t207, the generation is detected and the power generation detect signal SZ becomes high level. As a result, the detection by the charge detected circuit 202 and the voltage detecting circuit 207 start. Then at the time t208 when the charging is detected and the charge detect signal SA becomes high level, the oscillation stop detect signal SQ becomes low level. Then at the time t209, the voltage detect control signal SR becomes active (low level). If the stored voltage SC is higher than the second pre-fixed voltage (VOFF) at t209, the timepiece drive forcible stop) signal SO has low level. Therefore, the forcible stop control for the timepiece operation is lifted, and the reset of the forcible stop control counter 208 is lifted at t209.

Next, the example operation shown in FIG. 12 will be described. In FIG. 12, the first, the second, and the third voltages are used as reference voltages. At all the period in FIG. 12, the stored voltage signal SC is not lower than the second pre-fixed voltage VOFF. During the period between t301 and t304, and after t307, the generated voltage signal SI is high enough to make the power generation detect signal SZ have high level. The stored voltage signal SC becomes lower than the third pre-fixed voltage (VON) at the time t306, and then becomes higher than the third voltage just before the time t309. In this situation, during the period from t301 to t304 the signal SZ has high level, and during the time from t302 to t303 the charge detect signal SA has high level. Therefore during the period from t302 to t303 the forcible stop control counter 208 is not counting. At the time t305, the count, value of the counter 208 reaches the pre-fixed time T and the timepiece drive forcible stop signal SO becomes high level. Then at the time t306, the timepiece operation is in the forcible stop condition and the oscillation stop detect signal SQ has high level. At the time t306, the voltage detect result signal SS has low level. During the period from t305 to t306, the count value of the counter 208 is preserved. During the period from t306 to t309, the counter 208 has been reset.

Then at the time t307, generation is detected and the power generation detect signal SZ becomes high level. As a result, the detection by the charge detected circuit 202 and the voltage detecting circuit 207 start. Then at the time t308, when the charging is detected and the charge detect signal SA becomes high level, the timepiece drive forcible stop signal SO becomes low level, and the forcible stop control for the timepiece operation is lifted. However, at the time t308 the voltage detect result signal SS has low level. Next at the time t309, when the voltage detect control signal SR becomes active (low level), and the stored voltage SC which is higher than the third pre-fixed voltage (VON) is detected, the signal SS returns high level and the reset of the forcible stop control counter 208 is lifted. In this case, the signal SS returns high level at the time t309. Hence, due to the construction of the circuit for drive stop control, there are cases when the movement signal wave does not match the wave shown in this chart; during the period from t308 to t309 (temporal timepiece movement).

Next, the example operation shown in FIG. 13 will be described. In FIG. 13, during the period between t401 and t404 and after t407, the generated voltage signal SI is high enough to make the power generation detect signal SZ have high level, and the stored voltage becomes lower than the second voltage (VOFF) just before the time t405, and becomes larger than the third voltage (VON) after the time t408 when the charging begins. During the period from t401 to t404 the signal SZ has high level, and during the period from t402 to t403 the charge detect signal SA has high level. Therefore during the period from t402 to t403, the forcible stop control counter 208 is not counting. At the time t405 when the voltage detect control signal SR becomes active, it is detected that the stored voltage is lower than the second pre-fixed voltage (VOFF). Therefore the voltage detect result signal SS becomes low level, and the forcible stop control for the timepiece operation starts, and the forcible stop control counter 208 is reset. Then at the time t406, the oscillation stop is detected, and the oscillation stop detect signal SQ becomes high level.

At the time t407, the generation is detected and the power generation detect signal SZ becomes high level. As a result, the detection by the charge detected circuit 202 and the voltage detecting circuit 207 start. Then at the time t408 when the charging is detected and the charge detect signal SA becomes high level, the oscillation stop detect signal SQ becomes low level. Then at the time t409, the voltage detect control signal SR becomes active (low level). If the stored voltage SC is higher than the second pre-fixed voltage (VON) at the time t409, the timepiece drive forcible stop signal SO has low level. Therefore, the forcible stop control for the timepiece operation is lifted, and the reset of the forcible stop control counter 208 is lifted.

Figure 14:
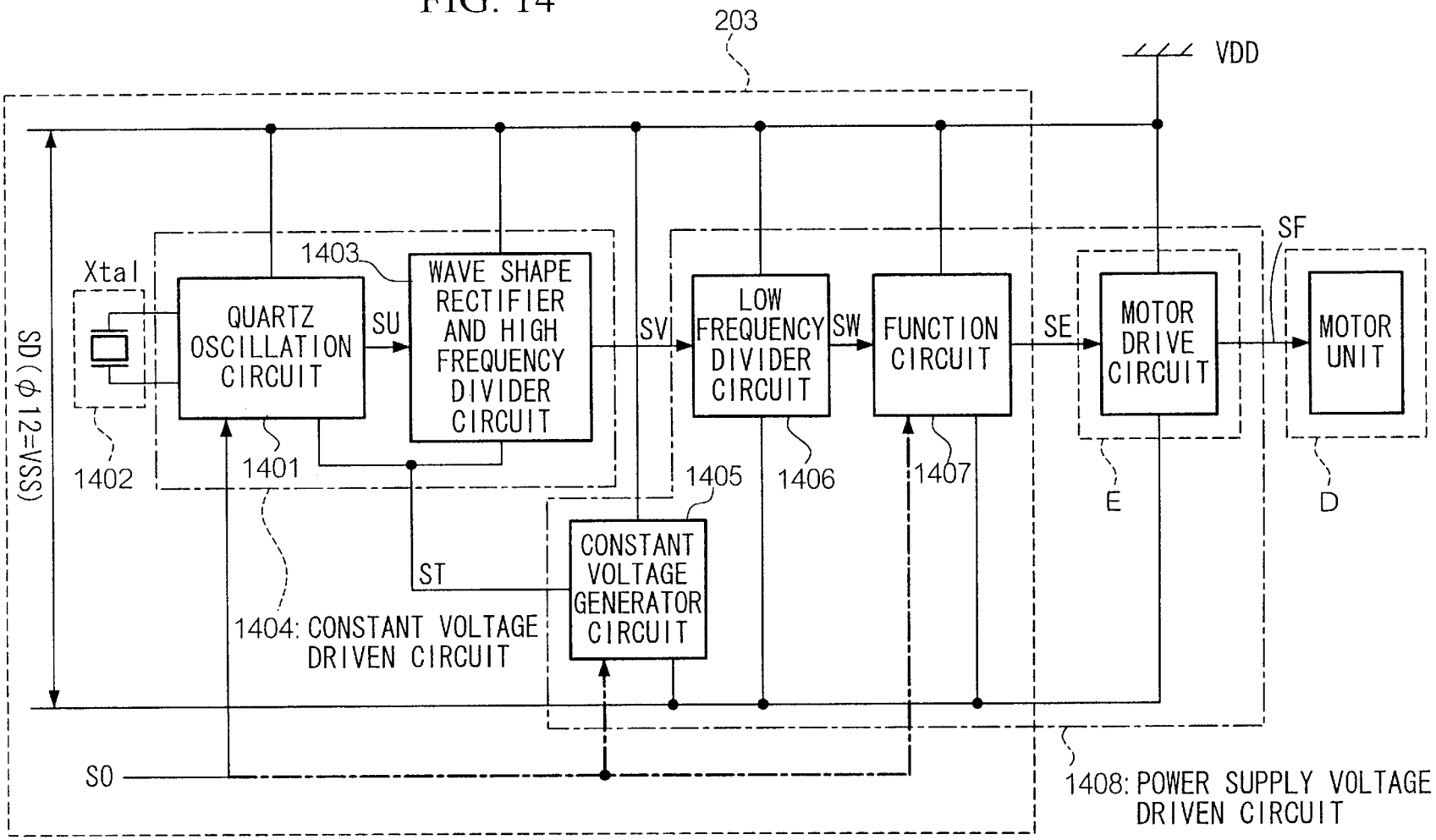
FIG. 14 is a block diagram for explaining target circuit of forcible stop in the timepiece of FIG. 2.

Now, with reference to FIGS. 14–21, the description will be given with respect to the circuit constructions which are direct target of the forcible stop control for the timepiece operation. FIG. 14 shows a block diagram of a part of construction inside of the timepiece control circuit 203, and a surrounding construction of it. The following figures use the same mark used in FIG. 2, hence we don't explain the same mark.

The timepiece control circuit 203 shown in FIG. 14 has a quartz, oscillation circuit, 1401, a wave shape rectifier and a high frequency divider circuit 1403, a constant voltage generator circuit 1405, a low frequency divider circuit 1406, and a function circuit, 1407. An external quarz oscillator 1402 is connect to the quartz oscillation circuit 1401. The quartz oscillation circuit 1401 generates an oscillation signal SU with fixed frequency which is determined by the external quartz oscillator 1402. The wave shape rectifier and high frequency divider circuit 1403 receives the signal SU, and rectifies and divides it, and then forms a signal which has several different frequencies, then outputs it as a divided output signal SV. The constant voltage generator circuit 1405 uses a raised and lowered voltage (VSS–VDD) from the raising and lowering circuit 49 as power supply, and provides the quartz oscillation circuit 1401, the wave shape rectifier and high frequency divider circuit 1403 and the like with a constant voltage power ST which is lower than the raised and lowered voltage (VSS–VDD). The low frequency divider circuit 1406 divides the divided output signal SV further, and changes the voltage, and then outputs it as a divided output signal SW. The function circuit 1407, by using the output SW, generates the motor driving control signal SE. Therefore inside of the timepiece control circuit 203 are two different circuits in view of power source voltage. The ones are those in the power supply voltage driven circuit 1408, and the others are those in a constant voltage driven circuit 1404. The power supply voltage driven circuit 1408 is a circuit which operates based on the power source voltage (VSS–VDD) supplied from the raising and lowering circuit 49, and the circuit, 1408 comprises the function circuit 1407 which uses the same power supply for the motor driving circuit E, the low frequency divider circuit 1406, and the constant voltage generator circuit 1405 and others. The constant voltage driven circuit 1404 is a circuit which operates based on the constant voltage ST supplied the constant voltage generation circuit 1405, and the circuit, 1404 comprises the quartz oscillation circuit, 1401, the wave shape rectifier and high frequency divider circuit 1403 and others, those of which require a lower voltage than the supply voltage in the motor driving circuit E, and a good stability of voltage.

In FIG. 14, the forcible stop control is performed on target circuits including the quartz oscillation circuit 1401, the constant voltage generator 1405, the function circuit 1407, and the motor driving circuit E. When the battery voltage SC decrease, the operation of the target circuits are stopped by the timepiece forcible stop signal SO, or a signal combination of the signal SO and the voltage detection result signal SS. The target circuits may be used alone or as a combination of other circuits to execute the forcible stop control. It is possible to apply different signal to the target circuits, for example, the timepiece drive forcible stop signal SO stops the quartz oscillation circuit 1401, and the voltage detection result signal SS stops the raising and lowering circuit 49. The configuration of the target circuits, the operation which are stopped by the timepiece drive forcible stop signal SO, or a combination of the signal SO and the voltage detection result signal SS, is described hereinbelow.

Figure 15:
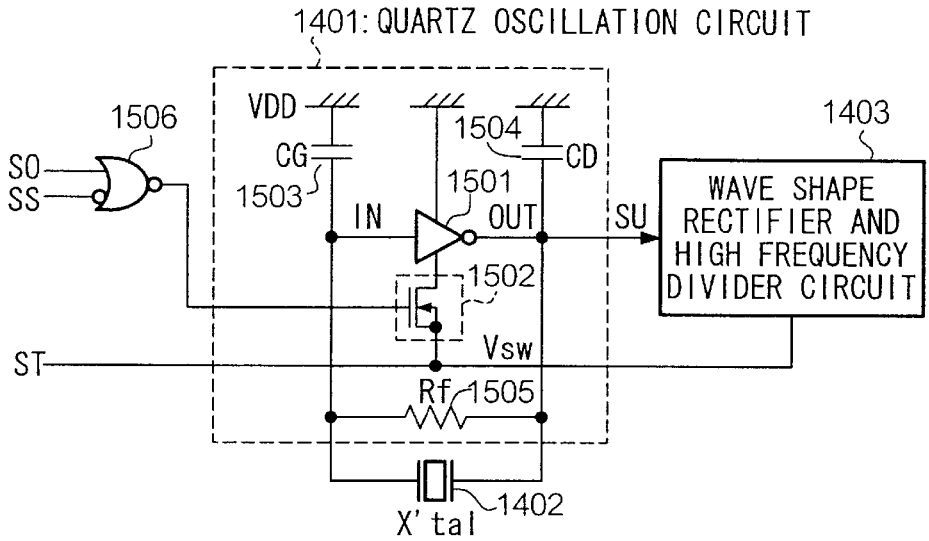
FIG. 15 is a block diagram which shows a construction of the quartz oscillation circuit 1401 in FIG. 14.

FIG. 15 shows one example of the quartz oscillation circuit 1401 in FIG. 14. The circuit 1401 comprises an oscillation inverter 1501, phase compensation capacitors 1503 and 1504, a feedback resistor 1505, and a switching element 1502 which is a n-channel field effect transistor for example. The oscillation inverter 1501 is inserted between the input and output terminals of the quartz oscillator 1402. The phase compensation capacitor 1503 is inserted between GND (VDD) and the input terminal of the oscillation inverter 1501. The phase compensation capacitor 1504 is inserted between GND (VDD) and the output terminal of the oscillation inverter 1501. The feedback resistor 1505 is connected in parallel to the quartz oscillator 1402. The switching element, 1502 is inserted between the line for supplying the constant power output ST and the power supply terminal of the oscillation inverter 1501. A double input NOR gate 1506 is provided for supplying a gate on-off control signal to the gate electrode of the switching element 1502. The NOR gate 1506 receives the timepiece drive forcible stop signal SO as a positive logic input, and the voltage detect result signal SS as a negative logic input. Therefore, when the signal SO has low level and the signal SS has high level, the NOR 1506 outputs a signal having high level. Hence the switching element 1502 becomes on and oscillation is carried out in the quartz oscillation circuit 1401, and as a quartz oscillation circuit output signal SU, an oscillation signal with pre-fixed frequency is output. When the signal SO has high level or the signal SS has low level, the NOR gate 1506 outputs a signal having low level, hence the switching element 1502 becomes off and the oscillation stops.

In the example shown in FIG. 15, a combination of the signal SO and SS is used as for a signal for controlling the switching element 1502 on and off. However, other signal may be used as such a signal. For example, it is possible to use only, the signal SO for controlling the switching element 1502 on and off. In this case, the NOR gate 1506 can be replaced with an inverter. Or it is also possible to use a p-channel transistor instead of n-channel for the switching element. In this case, the p-channel transistor is connected in series to the power supply terminal on the VDD side of the inverter 1501, and receives the signal SO in the gate terminal without changing the logic. It is also possible to use a transmission gate for the switching element 1502. For the switching element, 1502, it is desirable to use an element with lesser ON-state resistance, lower threshold voltage VTH, and higher DC amplification rate as possible.

Now referring FIG. 16, the description will be given with respect to a quartz oscillation circuit 1401*a* which is one variation of the quartz oscillation circuit 1401 in FIG. 15. In the circuit 1401*a*, a switching element 1602 which is a p-channel field effect transistor is inserted between GND (VDD) and the positive power supply terminal of the oscillation inverter 1602. Furthermore, a switching element which is a n-channel field effect transistor is inserted between the line for supplying the constant voltage ST and the negative power supply terminal of the oscillation inverter 1603. Furthermore, a switching element 1604 which is a p-channel field effect transistor is inserted between the output terminal of the inverter 1601 and the voltage VDD. The gate terminal of the switching element 1602 receives the output signal of the NOR gate 1506, and the gate terminal of the switching element 1603 receives the output signal of the inverter 1605 which inverts the output signal of the NOR gate 1506. The gate terminal of the switching element 1604 receives the output, signal of the inverter 1605. In this structure, it is possible to control on and off of the quartz oscillation in the same way in the quartz oscillation circuit 1401 in FIG. 15. Furthermore, the switching element 1604 becomes on and pulls up the output terminal of the inverter 1601 to GND (VDD) when the power supply is cut off.

Figure 16:
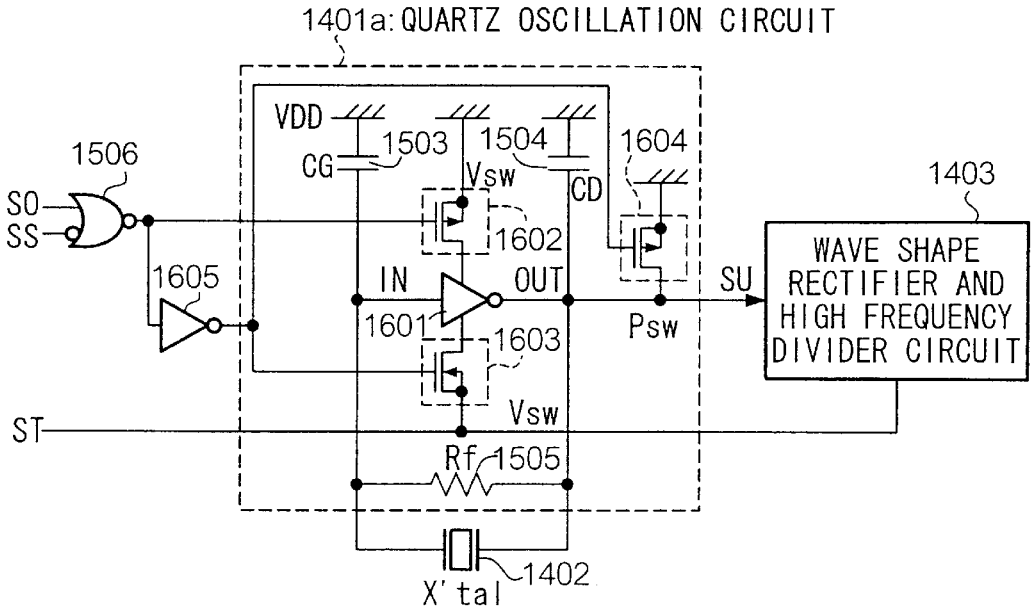
FIG. 16 is a block diagram which shows a variant of the quartz oscillation circuit 1401 in FIG. 14.

In the quartz oscillation circuit 1401*a* shown in FIG. 16, each of the switching transistors 1602 and 1603 is replaceable with a transmission gate, and it is also possible to omit one of them. As for the characteristics of the elements, those described in the explanation for FIG. 15 are preferable. It is also possible to place the switching element 1604 on the constant power output ST side instead of voltage VDD side, so that the element will pull down the output terminal of the inverter 1601 to ST. It, is also possible to replace the switching element 1604 with a micro current source not performing switching operation or a high resistance element.

Figure 17A:
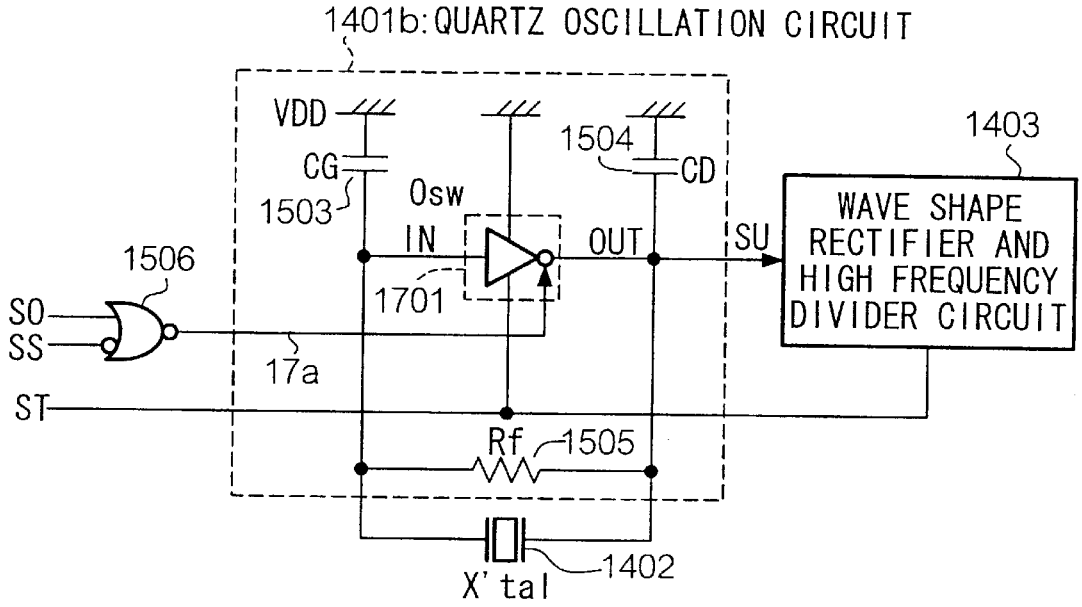
FIG. 17 is a block diagram which shows yet another variant of the quartz oscillation circuit 1401 in FIG. 14.
Figure 17B:
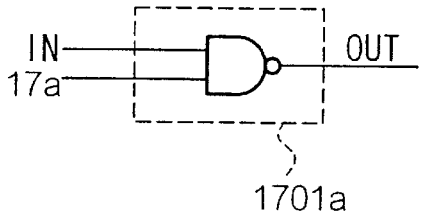

Next by referring to FIGS. 17A and 17B, the description will be given with respect to other variations of the quartz oscillation circuit 1401 in FIG. 15. A quartz oscillation circuit 1401*b* shown in FIG. 17A is different, from the circuit shown in FIG. 15 in not having the switching element, 1502, and the oscillation inverter 1701 is a 3-state invertor having an enable input terminal, and the output terminal of the NOR gate 1506 being directly put into the enable input terminal of the oscillation inverter 1701. In this structure, when the timepiece drive forcible stop signal SO has low level and the voltage detect result signal SS has high level, the oscillation inverter 1701 becomes active and the oscillation is performed. When the signal SO has high level or the signal SS has low level, the inverter 1701 becomes inactive state inactive which the output impedance of the invertor is very high, and the quartz oscillation stops. Incidentally, as shown in FIG. 17B, the inverter 1701 is replaceable with a double input NAND 1701*a*. In this case, the same operation is performed as that in FIG. 17A. The replacement of the inverter 1701 is not limited to a NAND logic circuit, but, also possible with, for example, NOR, AND, or NOR gate.

Next by referring to FIG. 18, the description will be given with respect to the structure of the constant voltage generator circuit 1405 shown in FIG. 14. In the structure shown in FIG. 18, the circuit 1405 comprises a differential amplifier. 1804, and transistors 1801, 1802, 1805, 1806, 1807, 1808, 1811, 1812, and 1850, and a capacitor 1809, and an inverter 1814. The differential amplifier 1804 comprises transistors 1840–1846. The transistors 1801 is inserted between the power supply line of VSS and the differential amplifier 1804. The transistor 1805 is inserted between the power supply line of VSS and the differential amplifier 1804. The transistor 1802 becomes active load to between the gate and source of the transistor 1801. The transistor 1806 becomes active load to between the gate and source of the transistor 1805. The capacitor 1809 is connected between one output terminal 18*a* of the differential amplifier 1804 and an output terminal 18b of the constant voltage generator circuit 1405. The transistors 1807, 1808, and 1812 constitute an output stage of the circuit 1405. The transistor 1850 is inserted between the power supply line of VDD and the output terminal 18*b*. The OR gate 1815 receives the signal SO as a positive logic and the signal SS as a negative logic. The output signal of the OR gate 1815 is supplied to the inverter 1814, and the gates of the transistors 1801 and 1811. The output signal of the inverter 1814 is supplied to the gate of the transistors 1805 and 1850.

When the signal SO has low level and the signal SS has high level, the transistors 1801 and 1805 become on, and the transistors 1811 and 1850 become off. Therefore the differential amplifier 1804 receives the power supply, and the transistor 1811 becomes off, and the transistor 181.0 becomes active, hence the constant power output voltage ST is generated. When the signal SO has high level or the signal SS has low level, the transistors 1801 and 1805 become off, and the transistor 1850 become on, and the differential amplifier 1804 does not receive the power supply, and the transistor 1811 becomes on, and the transistor 1810 becomes inactive, hence the constant power output voltage ST stops.

Figure 18:
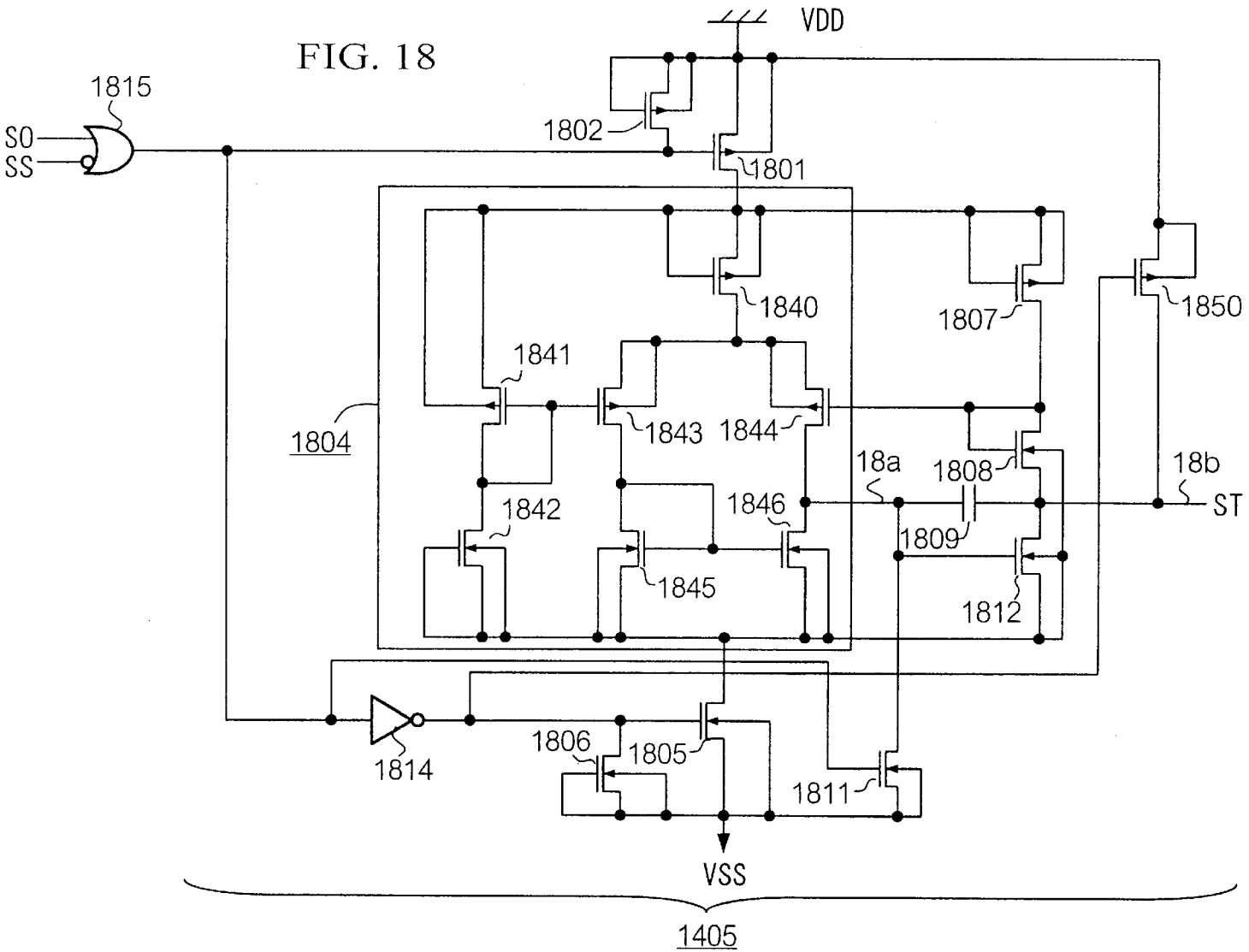
FIG. 18 is a block diagram which shows a construction of the constant voltage generator circuit 1405 in FIG. 14.

In the structure in FIG. 18, the transistors 1801 and 1805 are placed at the upper and lower part of the differential amplifier 1804 respectively but it is possible to omit one of them, or to replace them with transmission gates.

Next by referring to FIG. 19, the description will be given with respect to another example of the timepiece in which the raising and lowering circuit 49 can be controlled to stop. The circuit 49 comprises a raising and lowering switching circuit 1901, and a supplementary capacitor 49*c*, and N-channel MOS (metal oxide semiconductor) transistors 1902 and 1904, diodes 1903 and 1905. The raising and lowering switching circuit 1901 comprises several capacitors (49*a* and 49*b* in FIG. 1) and several switching elements. The output voltage is applied to the supplementary capacitor 49*c* and the capacitor 49*c* is charged. The output voltage VTKN of the battery 48 is supplied to the drain of the N-channel MOS transistor 1902, and the source of the transistor 1902 is connected to the input terminal of the raising and lowering switching circuit 1901. The output of the raising and lowering switching circuit 1901 is connected to the drain of the N-channel MOS transistor 11904, and the voltage VSS is output from the source of the transistor 1902 to the supplementary capacitor 49*c*. The diodes 1903 and 1905 are parasitic diodes to the transistors 1902 and 1904 respectively. The gates of the transistors 1902 and 1904 receive the output signal of the NOR gate 1906. The NOR gate 1906 receives the signal SO as a positive logic and the signal SS as a negative logic.

Figure 19:
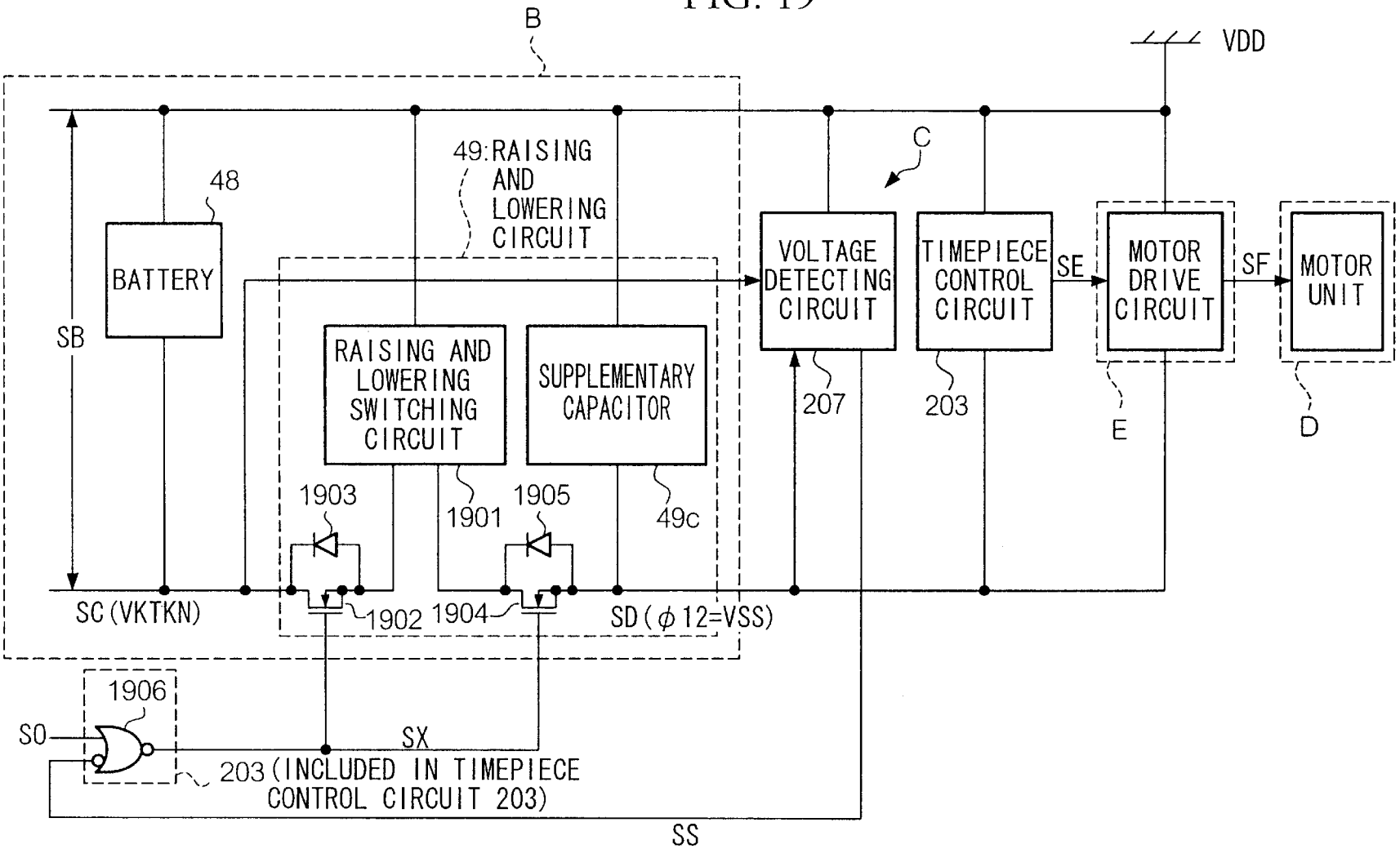
FIG. 19 is a block diagram which shows one example construction of the raising and lowering circuit 49 in FIG. 2.

In the raising and lowering circuit 49 in FIG. 19, when the timepiece drive forcible stop signal SO has low level and the voltage detect result signal SS has high level, the transistors 1902 and 1904 are on-state, hence the raising and lowering switching circuit 1901 is capable of raising and lowering. On the other hand, when the signal SO has high level and the signal SS has low level, the transistors 1902 and 1904 are off-state, hence the raising and lowering switching circuit 1901 is incapable of raising and lowering. Hence the output voltage VSS of the supplementary capacitor 49*c* falls. Incidentally the signal for controlling of on and off of the transistors 1902 and 1904 is not necessary a combination of the signal SO and SS, but the signal SO alone is adequate.

Figure 20:
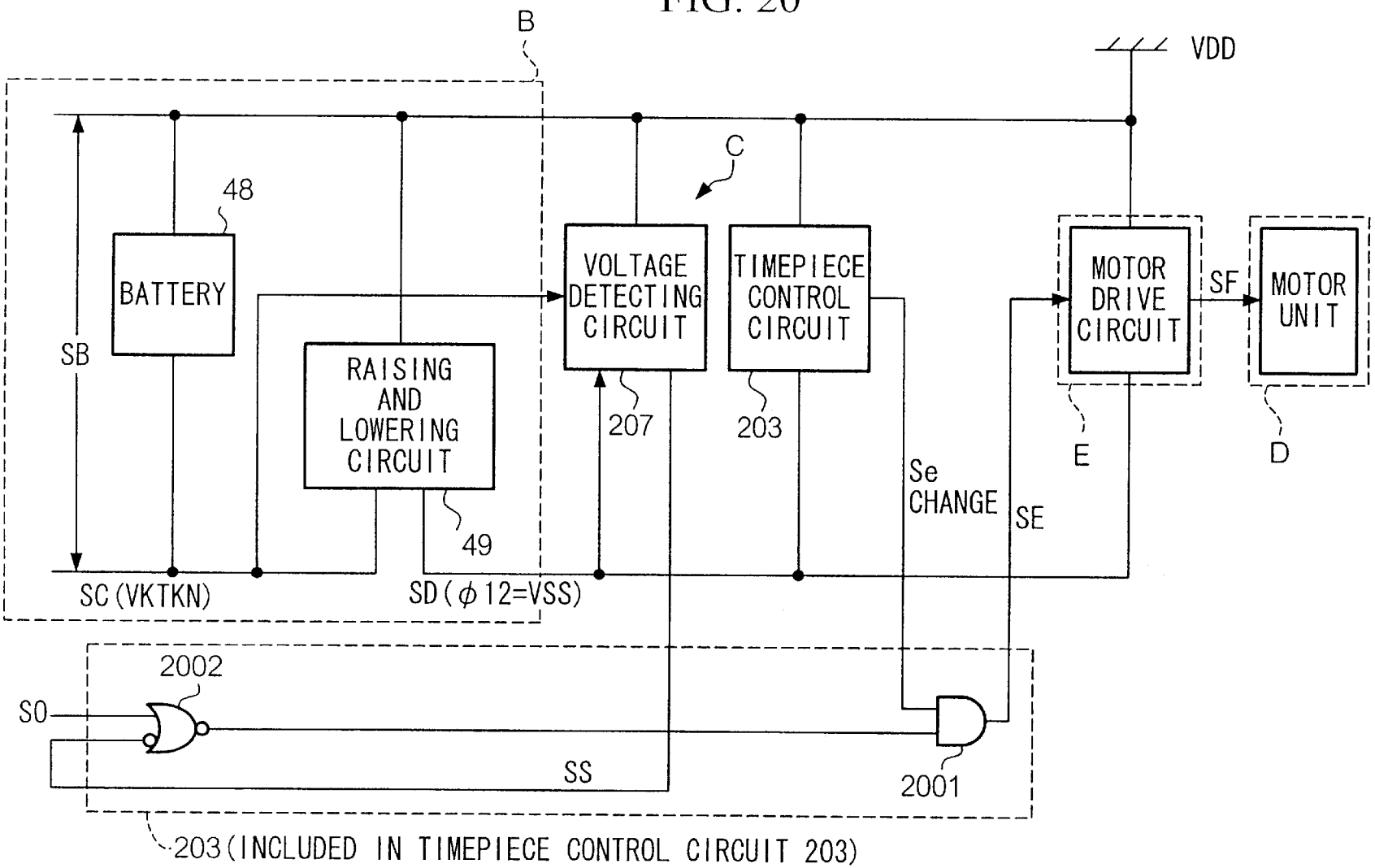
FIG. 20 is a block diagram which shows a variant of the configuration for signal lines which run from the timepiece control circuit to the motor drive circuit E in FIG. 2.

Next referring to FIG. 20, the description will be given with respect to another example of the timepiece. In this example, during the time keeping operation is under the forcible stop control, the supply of the motor drive control signal SE is stopped to stop the operation of the motor drive circuit E. In the structure in FIG. 20, the signal SO and the negative logic of the signal SS enter into the NOR gate 2002. The output signal of the NOR gate 2002 and the output signal (SE change) of the timepiece control circuit 203 enter into the double input AND gate 2001. The output signal of the AND gate 2001 enters into the motor drive circuit E. In FIG. 20, the output signal of the circuit 203 is written clown as an "Se change" which means a change signal for the signal SE.

In the structure in FIG. 20, when the timepiece drive forcible stop signal SO has low level and the voltage detect result signal SS has high level, the AND gate 2001 becomes enabled. Hence the signal SE enters into the motor drive circuit. On the other hand, when the signal SO has high level and the signal SS has low level, the AND gate 2001 becomes un-enabled. Hence signal SE is not supplied to the circuit E. Therefore it is possible to stop the operation of the motor unit D. Incidentally, in this example in FIG. 20, the signal from the timepiece control circuit 203 is controlled to stop the motor drive unit E. However it is possible to stop, for example, displaying the indication of the LCD panel if the digital timepiece has an LCD panel to display time.

Figure 21:
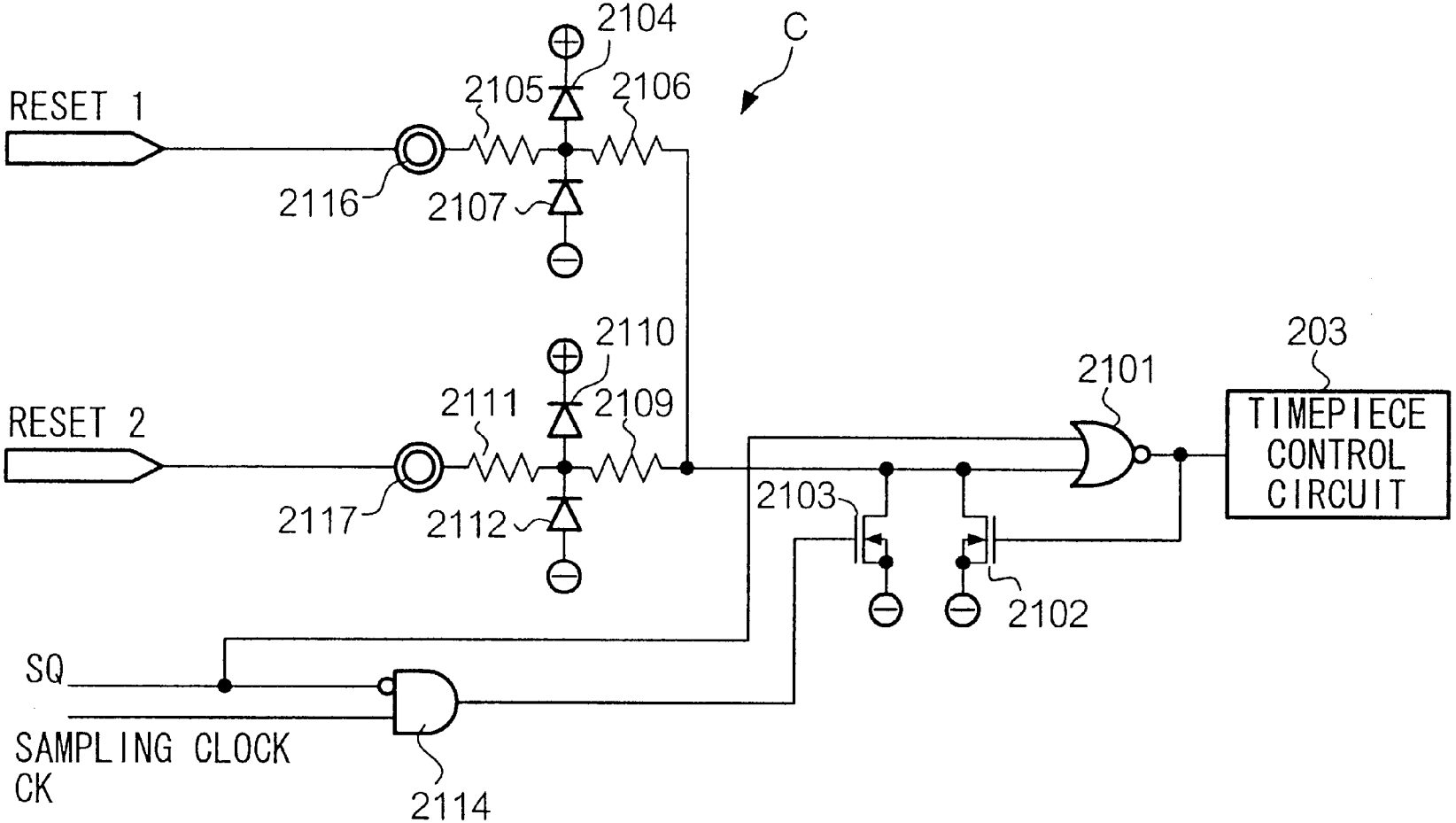
FIG. 21 is a block diagram which shows one example construction of external unit for signal input of the timepiece control circuit 203 in FIG. 2.

Next referring to FIG. 21, another example of the time piece will be described. In this example, when the timepiece is under the forcible stop control, a portion of operation of the control section C which determines the state of one or several external input terminal is stopped. FIG. 21 shows a block diagram which shows a structure for an input circuit in the timepiece control circuit 203. The input circuit is for external terminals 2116 and 2117 (terminals to input a reset signal, for example). In this case, the circuits shown in FIG. 21 are integrated onto, for example, an integrated circuit, and the external terminals 2116 and 2117 are used to receive input signals from outside of the integrated circuit,. Resistors 2105 and 2106, and diodes 2104 and 2107 constitute an input protection circuit corresponding to the external terminal 2116. Resistors 2111 and 2109, and diodes 2110 and 2112 constitute an input protection circuit corresponding to the external terminal 2117. The external terminal 2116 is connected to one of the two input terminals of a NOR gate 2101 via the resistors 2105 and 2106. The external terminal 2117 is connected to the same input terminal of the NOR gate 2101 via the resistors 2110 and 2109. Pull-down circuits 2103 and 2102 which are field effect transistors for example are inserted between the same input terminal of the NOR gate 2101 and a negative power line for fixing the input terminal, when the external input signal is undefined.

The output signal of the NOR gate 2101 enters into the timepiece control circuit 203. The oscillation stop detect signal SQ enters into the one of the two input terminals of the NOR gate 2101. The gate of the transistor 2102 is connected to the output terminal of the NOR gate 2101. The AND gate 2114 receives an inverted signal of the signal SQ and the pre-fixed sampling clock CK. The output signal of the AND gate 2114 is supplied to the gate of the transistor 2103. Under this structure, when the timepiece is operating, the signal SQ has low level, and the pull-down circuit by the transistor 2103 becomes on according to the sampling clock CK. On the other hand, when the timepiece operation stops, the signal SQ becomes high level (detection of oscillation stop condition), hence the pull-down circuit by the transistor 2102 and 2103 becomes off. Therefore at a time when the timepiece operation stops with the external terminals being in the reset state of high level, the current from the power supply through the pull-down circuit to the watch control circuit 203 will not flow. This makes possible to reduce the consumption of the electricity in the circuit during the timepiece operation stop. Here, the external terminals are for inputting reset signals, and shown as reset 1 and 2 in FIG. 21.

The invention may be embodied in other forms in addition to the present embodiment. For example, instead of the internal charging unit, it is possible to use an external charging unit or a removable charging unit. Also it is possible to use a charger connected to a commercial electricity, and connect, the charger to the battery then charge it. It is also possible to use light energy by using light electricity conversion element such as solar panel. It is also possible to use thermal energy by using thermo-electricity conversion element such as Peltier element. It Is also possible to use strain energy by using strain electricity conversion element such as piezo element. It is also possible to use induction by electromagnetism from outside of the timepiece, and generate electricity by it. In addition to timepieces, the present invention is applicable to stopwatches and other time keeping apparatus.

In the above embodiment, the charge detecting circuit 202 is placed on the different line from a charging line which is from the generator coil 44 to the battery 48, and detects the charging state by directly detecting the output terminal of the generator coil 44. However, instead, it is possible to place a resistor with low resistance in series on the charging line, and detect charging state by comparing a voltage drop directly or after amplification with a prescribed standard. The voltage drop in this explanation is due to the electric current. It is also possible, after determining the current value, to make an estimation of the stored voltage of the battery by applying smoothing operation or integral operation to the detected current value, and check a result whether exceeding a prescribed standard or not, and decide the existence of the charging.

In addition to the electronic timepieces, this invention is applicable to portable electronic appliances, such as portable phones, portable personal computers, and pocket calculators. In this case, a section equivalent to the drive unit driven by the power from the battery is a control circuit unit which controls functions of these portable electronic appliances.

What is claimed is:

1. An electronic timepiece comprising:

a battery capable of charging;

a charging section for charging the battery;

a timepiece drive circuit operating time keeping operation by using a stored electric power in the battery;

a displaying section for displaying time kept by the timepiece drive circuit;

a voltage detection section for detecting a stored voltage of the battery;

a charging detection section for detecting a state of charging by the charging section;

a control section for executing a forcible stop upon an operation of the timepiece drive circuit to reduce or stop a consumption power of the timepiece drive circuit when satisfying, for a prescribed time, a first condition that the stored voltage detected by the voltage detection section is lower than a first prescribed voltage which is higher than an operation stop voltage of the timepiece drive circuit, and a second condition that a detection result of the charging detection section indicates that the battery is not charged, and for lifting the forcible stop upon the time keeping operation when the detection result of the voltage detection section or the charging detection section satisfies a prescribed operation return condition.

2. An electronic timepiece according to claim 1, wherein the control section executes the forcible stop when the stored voltage detected by the voltage detecting section becomes lower than a second prescribed voltage which is higher than the operation stop voltage of the timepiece drive circuit and is lower than the first prescribed voltage before satisfying, for the prescribed time, the first and second condition.

3. An electronic timepiece according to claim 1, wherein the timepiece drive circuit comprises a quartz oscillation circuit, and performs the time keeping operation by using a oscillation of the quartz oscillation circuit, and wherein the control section executes the forcible stop upon the time keeping operation of the timepiece drive circuit by stopping the oscillation of the quartz oscillation circuit, or by stopping a supply of an output signal of the quartz oscillation circuit to latter circuits following to the quartz oscillation circuit.

4. An electronic timepiece according to claim 3, wherein the control section executes the forcible stop upon the operation of the timepiece drive circuit by stopping a power supply to the quartz oscillation circuit, which results in stopping the oscillation of the quartz oscillation circuit, or in stopping the supply of the output signal of the quartz oscillation circuit to latter circuits following to the quartz oscillation circuit.

5. An electronic timepiece according to claim 3, wherein the control section executes the forcible stop upon the operation of the timepiece drive circuit by fixing an input level or output level of a certain circuit in the quartz oscillation circuit, which results in stopping the oscillation of the quartz oscillation circuit, or in stopping the supply of the output signal of the quartz oscillation circuit to latter circuits following to the quartz oscillation circuit.

6. An electronic timepiece according to claim 1, wherein the timepiece drive circuit comprises a constant voltage, generator circuit, and performs time keeping operation by using an output voltage from the constant voltage generator circuit, and wherein the control section executes the forcible stop upon the operation of the timepiece drive circuit by stopping a generation of the constant voltage by the constant voltage generator circuit, which results in stopping a constant voltage driven circuit which is driven on the constant voltage.

7. An electronic timepiece according to claim 6, wherein the constant voltage driven circuit driven on the constant voltage by the constant voltage generator is a quartz oscillation circuit.

8. An electronic timepiece according to claim 6, wherein the constant voltage driven circuit driven on the constant voltage by the constant voltage generator is a frequency divider which divides an output signal of a quartz oscillation circuit.

9. An electronic timepiece according to claim 1, wherein the timepiece further comprises a raising and lowering, section for raising, lowering, or raising and lowering of the stored voltage of the battery, and wherein the control section executes the forcible stop upon the operation of the timepiece drive circuit by stopping an operation of the raising and lowering section, which results in stopping the power supply to a power supply voltage driven circuit which, in the timepiece drive circuit, is driven by the output voltage of the raising and lowering section, or by lowering the output voltage of the raising and lowering section to a drive stop voltage of the power supply voltage driven circuit, which results in stopping the power supply voltage driven circuit.

10. An electronic timepiece according to claim 1, wherein the control section, instead of executing the forcible stop upon the operation of the timepiece drive circuit, or in addition to executing the forcible stop upon the operation of the timepiece drive circuit, stops operation of the displaying section.

11. An electronic timepiece according to claim 10, wherein the displaying section comprises a stepping motor.

12. An electronic timepiece according to claim 10, wherein the displaying section comprises a liquid crystal panel.

13. An electronic timepiece according to claim 1, wherein the control section, when executing the forcible stop upon the operation of the timepiece drive circuit, stops operation of a circuit which determines a state of one or more external input terminals of the timepiece drive circuit.

14. An electronic timepiece according to claim 13, wherein one of the external input terminals is a reset terminal for receiving a signal to reset operation of the timepiece drive circuit.

15. An electronic timepiece according to claim 1, wherein the control section, in a case in which the stored voltage detected by the voltage detection section is lower than the first prescribed voltage, during measuring the non-charging state of the charging section for a prescribed time period, the charging detection section detects a charging state of the charging section, interrupts the measuring time of the non-charging state during the detection.

16. An electronic timepiece according to claim 1, wherein the operation return condition for the control section to lift the forcible stopping upon the operation of the timepiece drive circuit is that the charging detection section detects charging of the charging section.

17. An electronic timepiece according to claim 16, wherein the charging detection section detects whether or not the battery is charged upon detecting whether or not a charging current by the charging section exceeds a prescribed current value.

18. An electronic timepiece according to claim 16, wherein the charging detection section detects whether or not the battery is charged upon detecting whether or not an estimated battery voltage gained by applying a prescribed process to a charging current from the charging section exceeds a prescribed value.

19. An electronic timepiece according to claim 16, wherein the charging section comprises a generator, and wherein the charging detection section detects whether or not the battery is charged by a comparison result between a voltage of output terminals of the generator and a reference voltage prescribed for the battery.

20. An electronic timepiece according to claim 16, wherein a detection by the charging detection section is made on a different path from the charging path which runs from the charging section to the battery.

21. An electronic timepiece according to claim 16, wherein the operation return condition for the control section to lift the forcible stopping upon the operation of the timepiece drive circuit further comprises as a necessary condition a condition that the stored voltage of the battery exceeds a prescribed second voltage which is higher than the operation stop voltage of the timepiece drive circuit and is lower than the first prescribed voltage.

22. An electronic timepiece according to claim 16, wherein the control means executes the forcible stop upon the operation of the timepiece drive circuit when the stored voltage detected by the voltage detecting section becomes lower than a second prescribed voltage which is higher than the operation stop voltage of the timepiece drive circuit and is lower than the first prescribed voltage before satisfying the first and second condition, and wherein the operation return condition for the control section to lift the forcible stop upon the operation of the timepiece drive circuit comprises as a necessary condition a condition that the stored voltage of the battery exceeds a third prescribed voltage which is higher than the second prescribed voltage and is lower than the first prescribed voltage.

23. An electronic timepiece according to claim 1, wherein the charging section comprises a generator, wherein a generation detect section for detecting existence of generation of the generator is comprised, wherein the control means executes the forcible stop upon the operation of the timepiece drive circuit when the stored voltage detected by the voltage detecting section becomes lower than a second prescribed voltage which is higher than the operation stop voltage of the timepiece drive circuit and is lower than the first prescribed voltage before satisfying the first and second condition, and wherein the operation return condition for the control section to lift the forcible stop upon the operation of the timepiece drive circuit further comprises as a necessary condition a condition that the stored voltage of the battery exceeds a third prescribed voltage which is higher than the second prescribed voltage and is lower than the first prescribed voltage, and that the generation detect section detects generation.

24. An electronic timepiece according to claim 1, wherein the charging section comprises a generator which uses a rotary mechanism, a light,-electricity conversion element, a thermal-electricity conversion element, or a strain-electricity conversion element, and charges the battery with electricity generated by the generator.

25. A method for controlling an electronic timepiece, the timepiece comprising:

a battery capable of charging;

charging section for charging the battery;

a timepiece drive circuit operating time keeping operation by using a stored electric power in the battery;

a displaying section for displaying time kept by the timepiece drive circuit;

a voltage detecting section for detecting a stored voltage of the battery; and a charging detecting section for detecting a state of charging by the charging section, the method comprising the steps of:

executing a forcible stop upon an operation of the timepiece drive circuit to reduce or stop a consumption power of the timepiece drive circuit when satisfying, for a prescribed time, a first condition that the stored voltage detected by the voltage detecting section is lower than a first prescribed voltage which is higher than an operation stop voltage of the timepiece drive circuit, and a second condition that a detection result of the charging detecting section indicates that the battery is not charged; and lifting the forcible stop upon the time keeping operation when the detection result of the voltage detecting section or the charging detecting section satisfies a prescribed operation return condition.

* * * * *